US007527361B2

(12) United States Patent
Sugahara

(10) Patent No.: US 7,527,361 B2
(45) Date of Patent: May 5, 2009

(54) LIQUID TRANSPORTING APPARATUS, ACTUATOR UNIT, AND METHOD OF PRODUCING LIQUID TRANSPORTING APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 475 days.

(21) Appl. No.: 11/492,768

(22) Filed: Jul. 26, 2006

(65) Prior Publication Data

US 2007/0064052 A1 Mar. 22, 2007

(30) Foreign Application Priority Data

Jul. 27, 2005 (JP) ..... 2005-216706

(51) Int. Cl.
*B41J 2/045* (2006.01)

(52) U.S. Cl. ..... 347/68

(58) Field of Classification Search ..... 347/68, 347/69–72, 50, 54; 310/311, 317, 318, 323.17; 400/124.16
See application file for complete search history.

(56) References Cited

U.S. PATENT DOCUMENTS 7,213,912 B2 * 5/2007 Ito et al. ..... 347/72
7,441,874 B2 * 10/2008 Sugahara ..... 347/50
7,448,731 B2 * 11/2008 Murata ..... 347/68
2005/0041074 A1 2/2005 Watanabe et al.

FOREIGN PATENT DOCUMENTS

| | | |
|---|---|---|
| JP | H9286111 | 11/1997 |
| JP | H11274671 | 10/1999 |
| JP | 2001250824 | 9/2001 |
| JP | 200522148 | 1/2005 |

* cited by examiner

*Primary Examiner*—K. Feggins
(74) *Attorney, Agent, or Firm*—Baker Botts L.L.P.

(57) ABSTRACT

A piezoelectric layer with an individual electrode and a contact point formed thereon, and an FPC having a substrate on which a wiring is formed are in this order arranged on a surface of a channel unit having a pressure chamber. A first through hole is formed in an area, of the substrate, overlapping in a plan view with the contact point, and a second through hole is formed in another area, of the substrate, not overlapping in a plan view with the pressure chamber. An electroconductive material is filled in the first through hole, and a fixing material is filled in the second through hole. Accordingly, it is possible to electrically connect the individual electrode and the wiring of the FPC, and to mechanically connect the piezoelectric layer and the substrate of the FPC.

18 Claims, 16 Drawing Sheets

LIQUID TRANSPORTING APPARATUS, ACTUATOR UNIT, AND METHOD OF PRODUCING LIQUID TRANSPORTING APPARATUS

CROSS REFERENCE TO RELATED APPLICATION

The present application claims priority from Japanese Patent Application No. 2005-216706, filed on Jul. 27, 2005, the disclosure of which is incorporated herein by reference in its entirety.

BACKGROUND OF THE INVENTION

1. Field of the Invention

The present invention relates to a liquid transporting apparatus which transports a liquid, an actuator unit, and a method of producing the liquid transporting apparatus.

2. Description of the Related Art

An ink-jet head in which a common electrode or an individual electrode formed on an upper surface of a piezoelectric actuator and a wiring of an FPC (flexible printed circuit) arranged above the piezoelectric actuator are electrically connected is an example of an ink-jet head in which pressure is applied to the ink in a pressure chamber by the piezoelectric actuator to discharge ink from a nozzle communicating with the pressure chamber. For example, in an ink-jet head described in FIG. 23A and FIG. 23B of U.S. Patent Application Publication No. US 2005/0041074 A1 (corresponding to FIG. 23 of Japanese Patent Application Laid-open No. 2005-22148), pads of a wiring layer of the FPC are provided at positions facing contact-point land portions of a common electrode respectively, or at positions facing contact-point land portions of individual electrodes respectively, the common and individual electrodes being arranged in a piezoelectric sheet (piezoelectric layer) of an piezoelectric actuator, and a solder layer is formed on each of the pads. Further, each of the pads is electrically connected to one of the individual electrodes or the common electrode via the solder layer, by thermo compression bonding.

SUMMARY OF THE INVENTION

However, in the ink-jet head described in US Patent Application Publication No. US 2005/0041074 A1, when the pads of the FPC are bonded to the individual electrodes or the common electrode of the piezoelectric sheet by thermo compression bonding, it is necessary to apply a high pressure so as to compensate for a variation in the height among the contact-point land portions, and thus there is a fear that the piezoelectric sheet is damaged by the pressure. Further, since the piezoelectric sheet and the FPC are connected only at a portion of the electric connection, when an external pressure is exerted to the FPC, there is also a fear that the electric connection is disengaged or broken. Thus, for preventing the disengagement of the electric connection, it is conceivable to fill an adhesive or the like between the piezoelectric sheet and the FPC after performing the electrical connection. However, the filling of adhesive complicates the structure. Further, in a piezoelectric actuator which undergoes a so-called unimorph deformation, when a surface of the piezoelectric sheet is deformed substantially in a direction of thickness of the piezoelectric sheet, and if an adhesive or the like is filled between the piezoelectric sheet and the FPC, there is a possibility that the stiffness of the piezoelectric sheet of the piezoelectric actuator changes, thereby hindering an action of the piezoelectric actuator in some cases. In particular, when a piezoelectric actuator has a small number of the piezoelectric sheet, such as a single-layered piezoelectric sheet or double-layered piezoelectric sheet, the piezoelectric actuator has very low stiffness at the surface of the piezoelectric sheet, which becomes a problem.

An object of the present invention is to provide a liquid transporting apparatus and an actuator unit having a simple structure, in which an electric connection can be performed without damaging the piezoelectric layer on the surface of the piezoelectric actuator, and in which the electric connection is hardly disengaged; and to provide a method of producing such a liquid transporting apparatus.

According to a first aspect of the present invention, there is provided a liquid transporting apparatus which transports a liquid, including:

a channel unit in which a pressure chamber, a liquid discharging port, and a liquid channel reaching up to the liquid discharging port via the pressure chamber are formed;

a piezoelectric actuator which applies a discharge energy to the liquid in the pressure chamber and which includes: a plate fixed to one surface of the channel unit to cover the pressure chamber, a piezoelectric layer stacked on the plate to face the pressure chamber, and an electrode having a first area facing the pressure chamber and a second area not facing the pressure chamber, the electrode being formed on a surface of the piezoelectric layer on a side opposite to the plate so as to extend from the first area to the second area;

a wiring section which is connected to the piezoelectric actuator to supply a drive voltage to the piezoelectric actuator, and which includes: a substrate which is insulative and which is arranged to cover the piezoelectric actuator; a first wiring formed on a surface of the substrate on a side opposite to the piezoelectric actuator; a first through hole formed in an area of the substrate which overlaps with the second area of the electrode; and a second through hole formed in another area of the substrate which does not overlap with the pressure chamber and is different from the second area;

an electroconductive material filled in the first through hole and joined to the first wiring and the second area of the electrode to electrically connect the first wiring and the electrode; and a fixing material which is filled in the second through hole and joined to the substrate and the piezoelectric actuator to fix the wiring section to the piezoelectric actuator.

According to the first aspect of the present invention, with a simple structure in which the electroconductive material is filled in the first through hole formed in the substrate and the fixing material is filled in the second through hole formed in the substrate, it is possible to electrically connect the piezoelectric layer and the first wiring, and to mechanically connect the piezoelectric layer and the substrate. Further, the electroconductive material and the fixing material can be filled in the first through hole and the second through hole, respectively, by a method such as jetting liquid droplets of the electroconductive material and the liquid droplets of the fixing material in the first through hole and the second through hole respectively. Therefore, at the time of making such connections, it is not necessary to apply a pressure to the piezoelectric layer, and the damage to the piezoelectric layer can be prevented. Furthermore, since the piezoelectric layer and the substrate are mechanically connected by the fixing material, the electric connection between the first wiring and the individual electrode is hardly disengaged.

Further, in the liquid transporting apparatus of the present invention, the liquid channel may be formed as a plurality of individual liquid channels, and the pressure chamber may be formed as a plurality of pressure chambers; in the piezoelectric actuator, the plate and the piezoelectric layer may be formed to cover the pressure chambers, and the electrode may be formed as a plurality of individual electrodes corresponding to the pressure chambers respectively; and in the wiring section, the first through hole and the second through hole may be formed as a plurality of first through holes and a plurality of second through holes respectively. Accordingly, even in the liquid transporting apparatus in which a plurality of individual liquid channels is formed, with a simple structure in which the electroconductive material is filled in the first through holes formed in the substrate and the fixing material is filled in the second through holes formed in the substrate, it is possible to electrically connect the piezoelectric layer and the first wiring, and to mechanically connect the piezoelectric layer and the substrate.

Furthermore, in the liquid transporting apparatus of the present invention, the second through holes may be formed at positions each of which is outside of a first hole included in the first holes and formed on the outermost side in a predetermined direction in the substrate. Accordingly, when an external force is exerted from the predetermined direction on the substrate of the wiring section, a stress higher than a stress exerted on the electroconductive material is exerted on the fixing material. Therefore, the electric connection between the first wiring and the individual electrode is hardly disengaged.

In the liquid transporting apparatus of the present invention, inner surfaces of the substrate which define the first through hole and the second through hole respectively, may be tapered toward the piezoelectric layer. Accordingly, by making liquid droplets of the electroconductive material and the fixing material to flow along the tapered inner surfaces, respectively, it is possible to fill assuredly the electroconductive material and the fixing material in the first through hole and the second through hole respectively.

Further, in the liquid transporting apparatus of the present invention, the fixing material may be formed of an electroconductive material. Accordingly, by making the electroconductive material and the fixing material to be of a same material, it is possible to form the electroconductive material and the fixing material in one step.

In the liquid transporting apparatus of the present invention, the piezoelectric layer of the piezoelectric actuator may have a dummy electrode, which is insulated from the individual electrode, in an area on a surface of the piezoelectric layer opposite to the plate and facing the another area of the substrate in which the second through hole is formed; and the fixing material filled in the second through hole may be joined to the substrate and the dummy electrode. Accordingly, by joining the fixing material and the dummy electrode, a joining strength of the wiring section of the piezoelectric layer is enhanced.

In the liquid transporting apparatus of the present invention, the wiring section may further include a second wiring which is formed on the surface of the substrate on the side opposite to the piezoelectric actuator; the plate may be made of an electroconductive material; a third through hole penetrating through the piezoelectric layer may be formed in an area, of the piezoelectric actuator, overlapping with the second through hole; and the fixing material may be filled in the second through hole and the third through hole and joined to the second wiring and the plate to electrically connect the second wiring and the plate. Accordingly, by filling the electroconductive material in the second through hole and the third through hole, it is possible to electrically connect the plate and the second wiring, the plate functioning as a common electrode which generates an electric potential difference between the plate and the first electrode, the first electrode facing the plate with the piezoelectric layer sandwiched therebetween, and the second wiring formed on the same surface on which the first wiring is formed. Further, since the fixing material is filled in the third through hole, in addition to the second through hole, the joining strength of the substrate and the piezoelectric layer is enhanced.

In the liquid transporting apparatus of the present invention, an opening of the pressure chamber may be formed on the one surface of the channel unit; and the third through hole may penetrate through the piezoelectric layer and the plate and may be formed to correspond to a position in the one surface of the channel unit at which the opening of the pressure chamber is absent. Accordingly, since the third through hole is extended up to the plate, and the fixing material is filled in the third through hole, the joining strength of the substrate and the piezoelectric layer is enhanced. Further, by forming the piezoelectric layer on the surface of the plate, in which the through holes are formed, with an aerosol deposition method (AD method) or a vapor deposition method, it is possible to easily form the piezoelectric layer with the through holes formed therein.

Further, in the liquid transporting apparatus of the present invention, a projection projecting toward a side opposite to the plate may be formed in an area on the surface of the piezoelectric layer on the side opposite to the plate, the area not overlapping with the pressure chamber. Alternatively, a projection projecting toward the piezoelectric layer may be formed in an area on a surface of the substrate of the wiring section, the surface facing the piezoelectric layer, and the area not overlapping with the pressure chamber. In any of the cases, due to the projection, the piezoelectric layer and the substrate hardly come in mutual contact at an area facing the pressure chamber. Therefore, it is possible to prevent the substrate from having an adverse effect on the transportation of the liquid.

In the liquid transporting apparatus of the present invention, the wiring section may be arranged in an area overlapping with the pressure chamber to form a gap between the wiring section and the piezoelectric actuator. In this case, there is no fear that the wiring section hinders the deformation of the piezoelectric actuator.

According to a second aspect of the present invention, there is provided an actuator unit including:

a piezoelectric actuator which includes: a plate which is supported by a supporting section; a piezoelectric layer which is stacked on one surface of the plate; and an electrode formed on a surface of the piezoelectric layer on a side opposite to the plate, and having a first area and a second area, the first area not overlapping with a supported area which is supported by the supporting section of the plate, and the second area overlapping with the supported area of the plate;

a wiring section which is connected to the piezoelectric actuator to supply a drive voltage to the piezoelectric actuator, and which includes: a substrate which is insulative and which is arranged to cover the piezoelectric actuator; a first wiring formed on a surface of the substrate on a side opposite to the piezoelectric actuator; a first through hole formed in an area, of the substrate, overlapping with the second area of the electrode; and a second through hole formed in another area of the substrate which overlaps with the supported area of the plate and is different from the second area of the electrode;

an electroconductive material which is filled in the first through hole to electrically connect the first wiring and the electrode; and a fixing material which is filled in the second through hole to fix the wiring section to the piezoelectric actuator.

According to the second aspect of the present invention, in the actuator unit, the wiring section and the piezoelectric actuator are fixed firmly and there is no fear that the wiring section hinders the deformation of the piezoelectric actuator. Therefore, the electrical connection and the mechanical connection between the wiring section and the piezoelectric actuator are highly reliable.

According to a third aspect of the present invention, there is provided a method of producing a liquid transporting apparatus, the liquid transporting apparatus including:

a channel unit in which a pressure chamber is formed;

a piezoelectric actuator which applies a discharge energy to the liquid in the pressure chamber, and which has: a plate fixed to one surface of the channel unit to cover the pressure chamber; a piezoelectric layer stacked on the plate to face the pressure chamber; and an electrode formed on a surface of the piezoelectric layer on a side opposite to the plate; and a wiring section including a substrate which is insulative and in which a first wiring is formed, the wiring section being connected to the piezoelectric actuator to supply a drive voltage to the piezoelectric actuator, the method including:

a step of providing the substrate and the piezoelectric actuator which is connected to the channel unit;

a wiring-section forming step of forming the wiring section by forming a first through hole in an area, of the substrate, which overlaps with the electrode and does not overlap with the pressure chamber when the substrate is connected to the piezoelectric actuator which has been connected to the channel unit; and by forming a second through hole in another area of the substrate which does not overlap with the electrode and the pressure chamber when the substrate is connected to the piezoelectric actuator which has been connected to the channel unit;

an arranging step of arranging the substrate of the wiring section such that the area of the substrate in which the first through hole is formed overlaps with a connecting area of the electrode;

an electroconductive liquid droplet jetting step of jetting a liquid droplet of an electroconductive material, toward the first through hole in the substrate, from a side of the substrate opposite to the piezoelectric layer of the piezoelectric actuator;

an electroconductive liquid droplet curing step of curing the liquid droplet of the electroconductive material jetted in the electroconductive liquid droplet jetting step;

a fixing liquid droplet jetting step of jetting a liquid droplet of a fixing material toward the second through hole from the side of the substrate opposite to the piezoelectric layer; and a fixing liquid droplet curing step of curing the liquid droplet of the fixing material jetted in the fixing liquid droplet jetting step.

Accordingly, by a simple method of forming the wiring section in which the first through hole and the second through hole are formed, arranging the wiring section such that the first through hole and the connecting area of the first electrode overlap, jetting the liquid droplet of the electroconductive material toward the first through hole and curing the jetted liquid droplet of the electroconductive material, and jetting the liquid droplet of the fixing material toward the second through hole and curing the jetted liquid droplet of the fixing material, it is possible to electrically connect the first wiring and the electrode, and to mechanically connect the substrate and the piezoelectric layer. Further, it is possible to electrically and mechanically connect the substrate of the wiring section and the piezoelectric layer of the piezoelectric actuator without applying a pressure to the piezoelectric layer. Therefore, it is possible the piezoelectric layer from being damaged. Furthermore, since the piezoelectric layer and the substrate are mechanically connected by the fixing material, the electric connection between the first wiring and the electrode is hardly disengaged.

In the method of producing the liquid transporting apparatus of the present invention, the fixing liquid droplet jetting step may be performed before the electroconductive-liquid droplet jetting step. Accordingly, in the fixing liquid droplet jetting step, positions of the piezoelectric layer and the substrate are not shifted even upon removing jigs holding the piezoelectric layer and the substrate after mechanically connecting the piezoelectric layer and the substrate. Therefore, after the fixing liquid droplet jetting step in which the piezoelectric layer and the substrate have been mechanically connected and after removing the jigs holding the piezoelectric layer and the substrate, it is possible to perform the electroconductive-liquid droplet jetting step. Therefore, in a case of producing a plurality of liquid transporting apparatuses, while performing the electroconductive-liquid jetting step for a liquid transporting apparatus, the jigs which are removed can be used for producing the next liquid transporting apparatus.

Furthermore, in the method of producing the liquid transporting apparatus of the present invention, the liquid droplet of the fixing material may be the liquid droplet of the electroconductive material; and the electroconductive liquid droplet jetting step and the fixing liquid droplet jetting step may be performed simultaneously. Accordingly, the producing process can be simplified by simultaneously performing the electroconductive liquid droplet jetting step and the fixing liquid droplet jetting step.

In the method of producing the liquid transporting apparatus of the present invention, after simultaneously performing the electroconductive liquid droplet jetting step and the fixing liquid droplet jetting step, the electroconductive liquid droplet curing step and the fixing liquid droplet curing step may be performed simultaneously. Accordingly, the producing process can be further simplified by simultaneously performing the electroconductive liquid droplet curing step and the fixing liquid droplet curing step.

The method of producing the liquid transporting apparatus of the present invention may further include, before the arranging step, a projection forming step of forming a projection, which projects toward a side opposite to the plate, at an area on the surface of the piezoelectric layer on the side opposite to the plate, the area not overlapping with the pressure chamber. Accordingly, by forming the projection on the surface of the piezoelectric layer, the surface being on the side opposite to the plate (such as a vibration plate) before arranging the substrate, the substrate hardly comes in contact with the piezoelectric layer at the area facing the pressure chamber when the substrate is arranged.

According to a fourth aspect of the present invention, there is provided a method of producing a liquid transporting apparatus, the liquid transporting apparatus including:

a channel unit in which a pressure chamber is formed;

a piezoelectric actuator having a plate formed of an electroconductive material and fixed to one surface of the channel unit to cover the pressure chamber, a piezoelectric layer stacked on the plate to face the pressure chamber, and an electrode formed on a surface of the piezoelectric layer on a side opposite to the plate; and a wiring section arranged to cover the piezoelectric actuator, connected to the piezoelectric actuator to supply a drive voltage to the piezoelectric actuator, and including a substrate which is insulative and which has a first wiring for applying the drive voltage to the electrode and a second wiring for applying a fixed electric potential to the plate, the first wiring and the second wiring being formed in the substrate;

the method including:

a step of providing the substrate, the plate, and the channel unit;

a wiring section forming step of forming the wiring section by forming a first through hole in an area, of the substrate, which overlaps with the electrode and does not overlap with the pressure chamber when the substrate is connected to the piezoelectric actuator, and forming a second through hole in another area of the substrate which does not overlap with the pressure chamber and the electrode when the substrate is connected to the piezoelectric actuator;

a through hole forming step of forming a through hole in an area, of the plate, which does not overlap with the pressure chamber when the plate is connected to the channel unit;

a step of forming the piezoelectric layer on one surface of the plate, with one of an aerosol deposition method and a vapor deposition method and after the through hole forming step, to form a third through hole in the area of the plate in which the through hole has been formed, the third through hole penetrating through the plate and the piezoelectric layer;

a first electrode forming step of forming a first electrode on a surface of the piezoelectric layer on a side opposite to the plate;

an arranging step of arranging the substrate of the wiring section such that the area of the substrate in which the first through hole has been formed overlaps with a connecting area of the first electrode, and that the another area of the substrate in which the second through hole has been formed overlaps with the area of the plate and an area of the piezoelectric layer in which the third through hole has been formed;

an electroconductive liquid droplet jetting step of jetting a liquid droplet of an electroconductive material, toward the first through hole and the second through hole formed in the substrate, from a side of the substrate opposite to the piezoelectric layer; and an electroconductive droplet curing step of curing the liquid droplet of the electroconductive material jetted in the electroconductive liquid droplet jetting step.

According to the fourth aspect of the present invention, by forming the piezoelectric layer with a method such as the AD method or the vapor deposition method on a surface of the plate such as a vibration plate in which the through hole has been formed, a through hole communicating with the through hole formed in the plate can be formed in the piezoelectric layer. Therefore, a step for separately forming a through hole in the piezoelectric layer is not necessary, thereby simplifying the producing process. Further, it is possible to electrically connect the second wiring and the plate, such as a vibration plate which functions as a common electrode, by jetting the electroconductive liquid in the second through hole to fill the electroconductive material in the second through hole and the third through hole. Therefore, a separate step for electrically connecting the plate and the second wiring is not necessary, and the producing process is simplified.

DETAILED DESCRIPTION OF THE PREFERRED EMBODIMENTS

First Embodiment

A first embodiment according to the present invention will be described below with reference to the diagrams. The first embodiment is an example in which the present invention is applied to an ink-jet head which perform recording on a recording paper by discharging ink from a nozzle.

Figure 1:
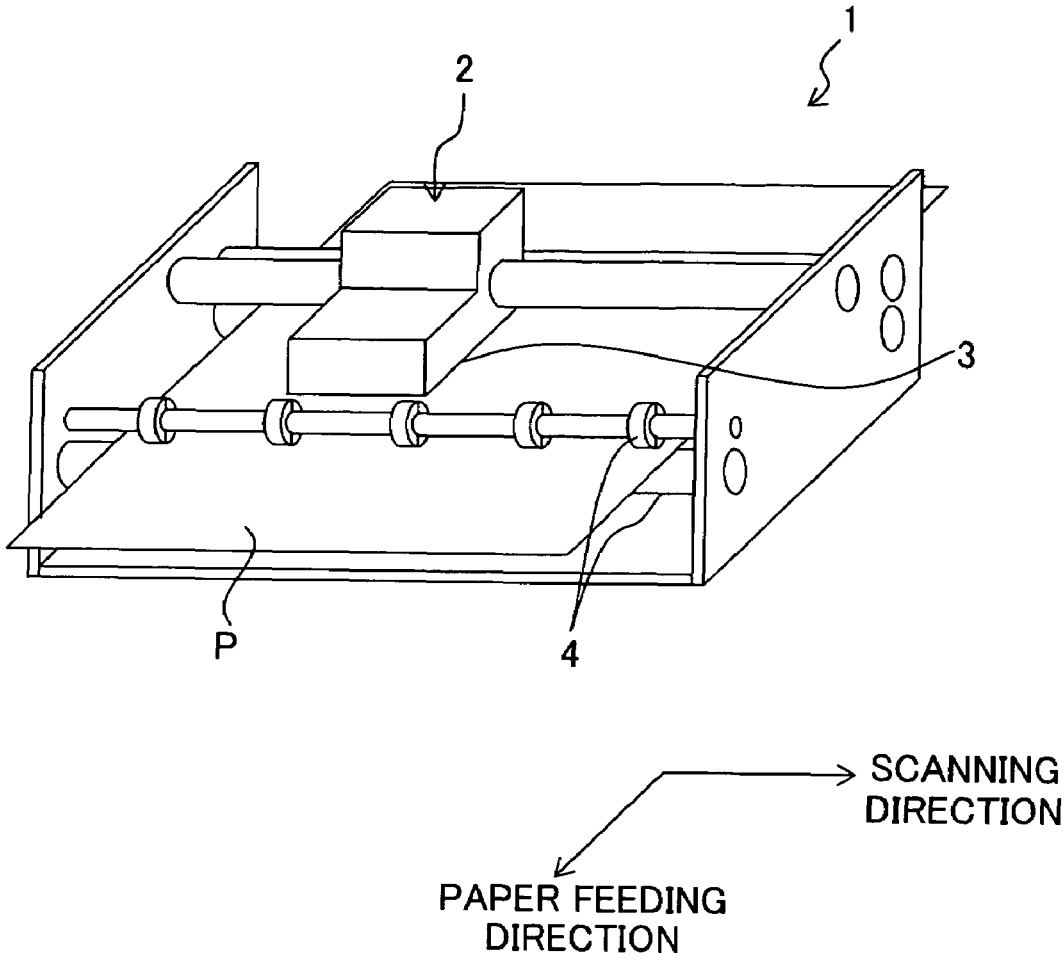
FIG. 1 is schematic perspective view of an ink-jet printer according to a first embodiment of the present invention.

FIG. 1 is a schematic perspective view of an ink-jet printer 1 according to the first embodiment. As shown in FIG. 1, the ink-jet printer 1 includes a carriage 2 which is movable in a left and right direction (scanning direction) in FIG. 1, an ink-jet head 3 of a serial type which is provided to the carriage 2 and discharges ink onto a recording paper P, and transporting rollers 4 which transport or carry the recording paper P in a paper feeding direction (forward direction in FIG. 1). The ink-jet head 3, while moving integrally with the carriage 2 in the scanning direction, records an image and/or a character (hereinafter referred simply as "image") by discharging ink onto the recording paper P from nozzles 16 (see FIG. 2). The recording paper P with an image recorded thereon is discharged in the paper feeding direction by the transporting rollers 4.

Figure 2:
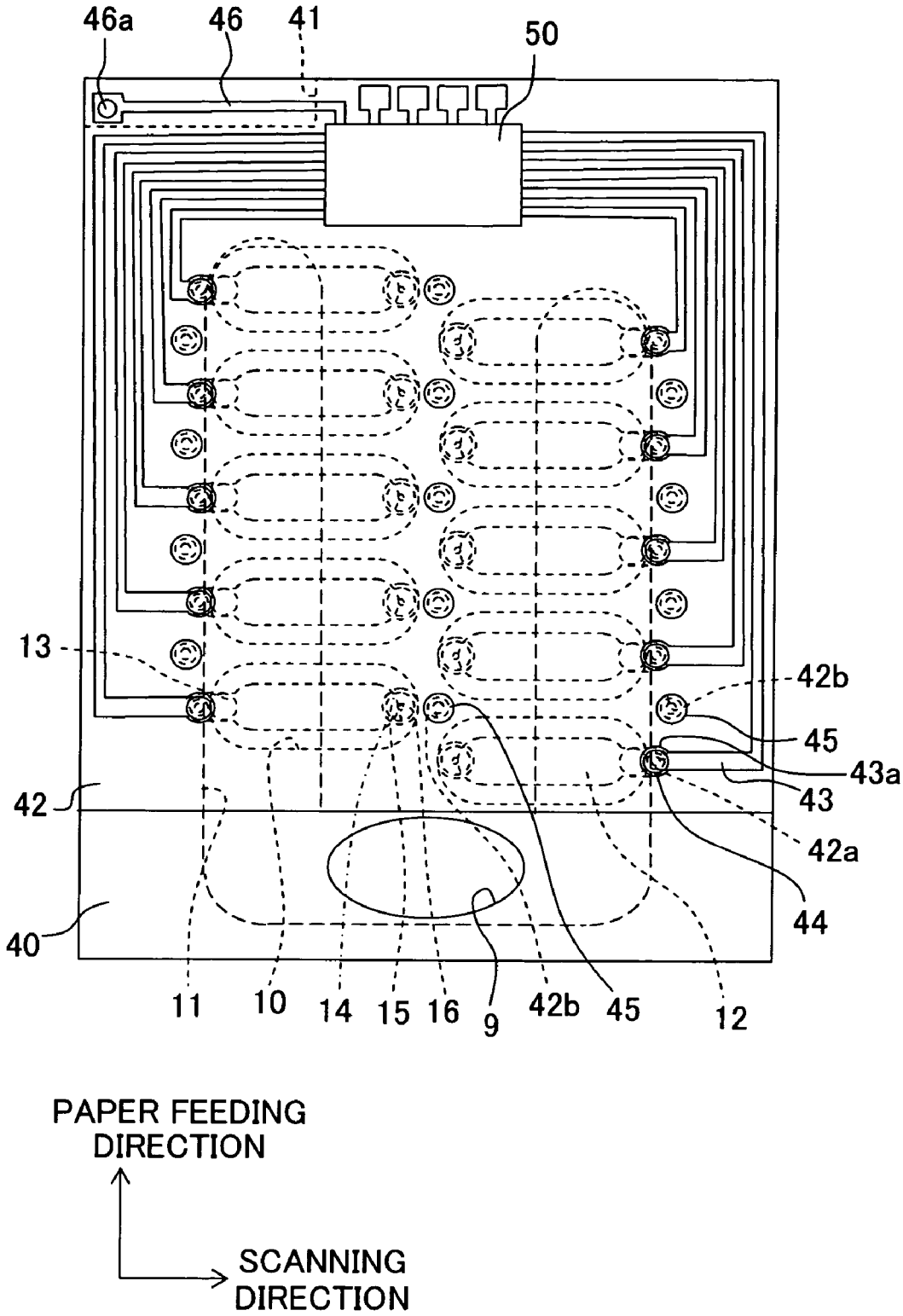
FIG. 2 is a plan view of the ink-jet head in FIG. 1.
Figure 3:
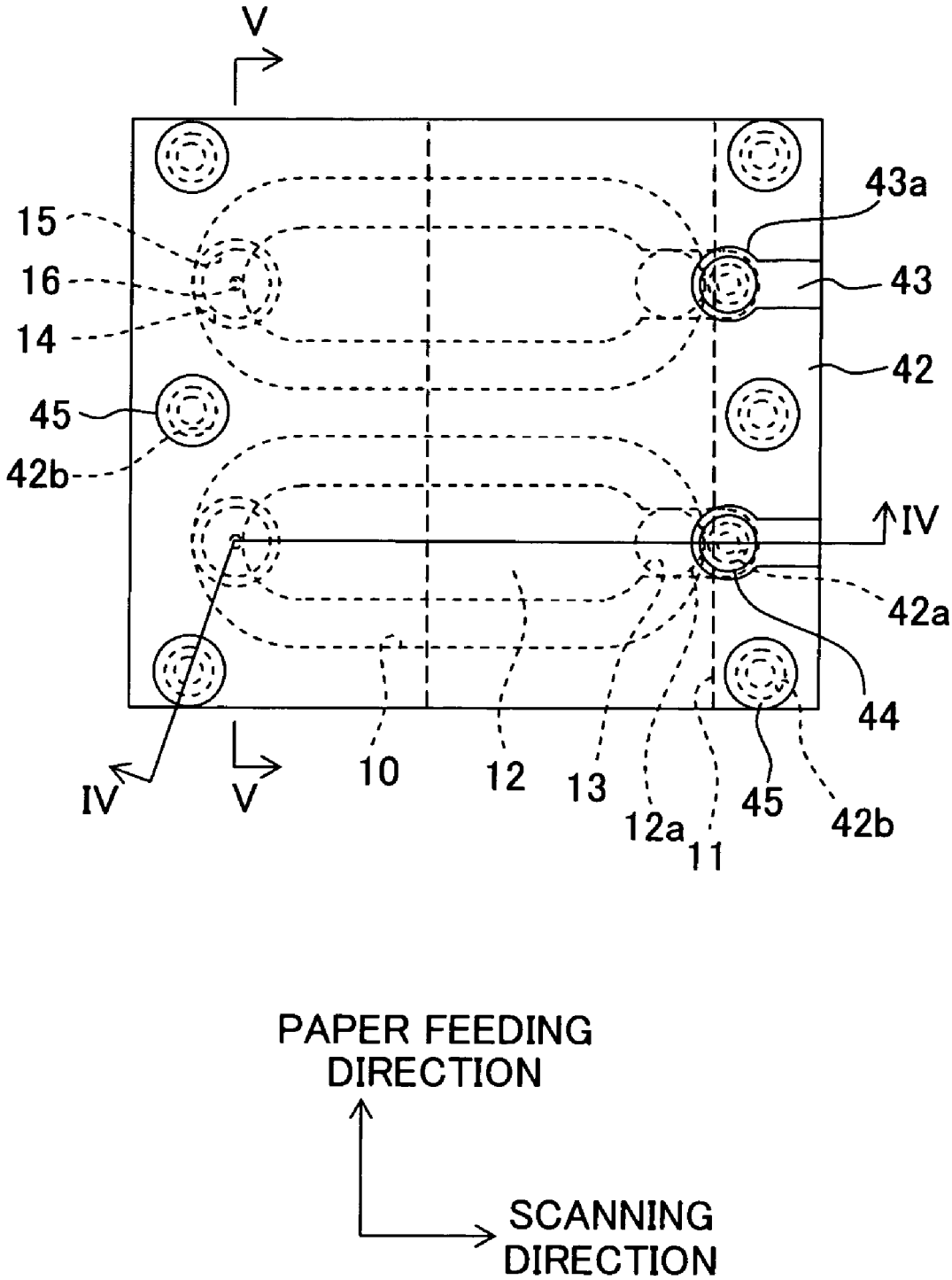
FIG. 3 is a partially enlarged view of FIG. 2.
Figure 4:
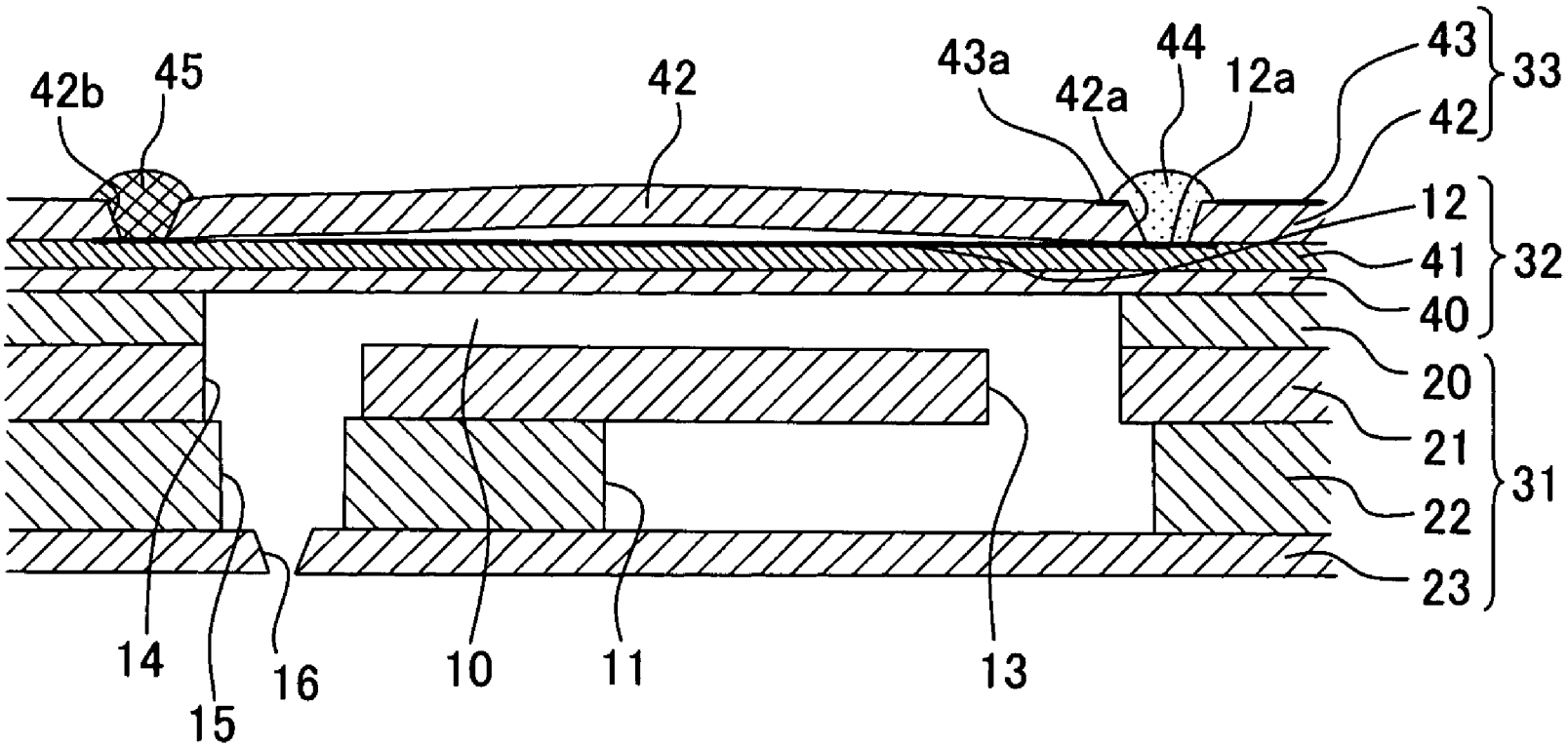
FIG. 4 is a cross-sectional view taken along a line IV-IV shown in FIG. 3.
Figure 5:
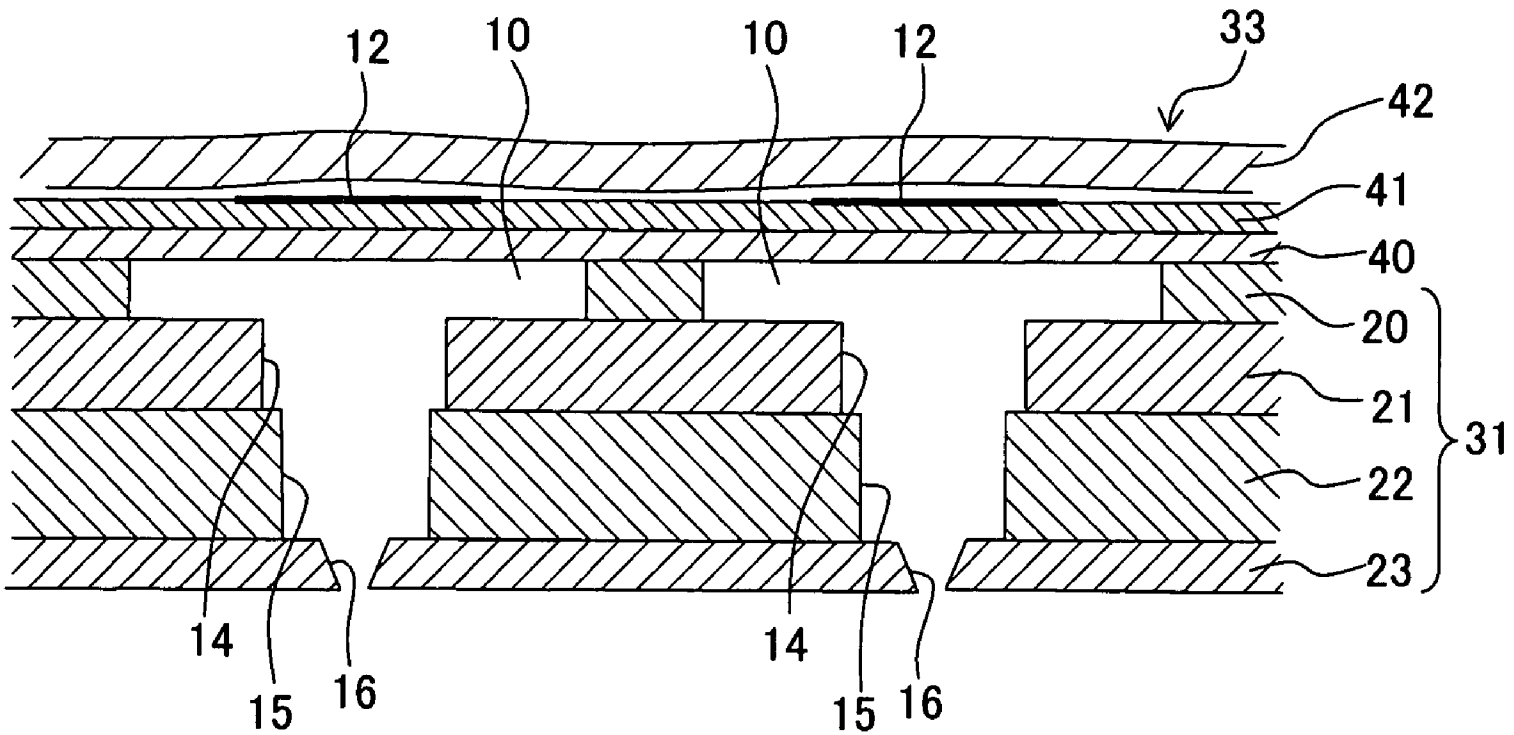
FIG. 5 is a cross-sectional view taken along a line V-V shown in FIG. 3.
Figure 6:
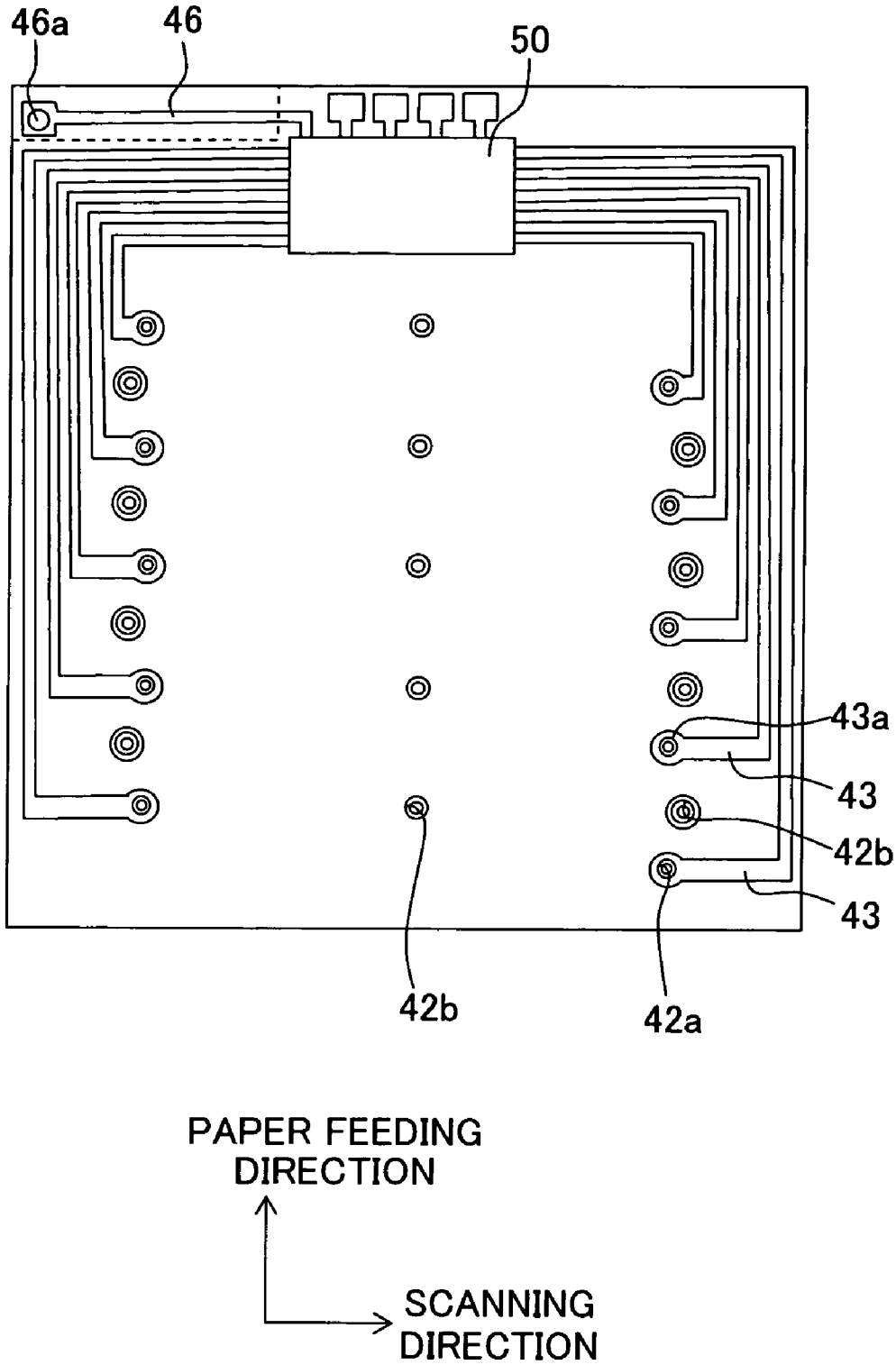
FIG. 6 is a plan view of an FPC and a driver IC in FIG. 1.

Next, the ink-jet head 3 will be explained below with reference to FIGS. 2 to 6. FIG. 2 is a plan view of the ink-jet head 3. FIG. 3 is a partially enlarged view of FIG. 2. FIG. 4 is a cross-sectional view taken along a line IV-IV shown in FIG. 3. FIG. 5 is a cross-sectional view taken along a line V-V shown in FIG. 3. FIG. 6 is a plan view of an FPC 33 shown in FIG. 2.

As shown in FIGS. 2 to 6, the ink-jet head 3 includes a channel unit 31 in which a plurality of individual ink channels each including a pressure chamber 10 is formed; a piezoelectric actuator 32 arranged on an upper surface of the channel unit 31; and a flexible printed circuit (FPC) (wiring member) 33 arranged on an upper surface of the piezoelectric actuator 32.

As shown in FIGS. 4 and 5, the channel unit 31 includes a cavity plate 20, a base plate 21, a manifold plate 22, and a nozzle plate 23, and these four plates are connected by joining in a stacked form or layers. Among these four plates, the cavity plate 20, the base plate 21, and the manifold plate 22 are stainless steel plates, and an ink channel such as a manifold channel (common pressure chamber) 11 and the pressure chamber 10, which will be described later on, is formed in these stainless steel plates, by a method such as an etching. Further, the nozzle plate 23 is made of a high-molecular synthetic resin material such as polyimide, and is joined to a lower surface of the manifold plate 22. Alternatively, the nozzle plate 23 may also be made of a metallic material such as stainless steel, similar to the three plates 20 to 22.

As shown in FIGS. 2 to 4, the cavity plate 20 is formed with a plurality of pressure chambers 10 (for example, 10 pieces of pressure chambers) which are arranged along a plane and each of which has an opening in the upper surface of the cavity plate 20, and these pressure chambers 10 are arranged in two rows in the paper feeding direction (up and down direction in FIG. 2). Each of the pressure chambers 10 is shaped to be substantially elliptical in a plan view which is long in the scanning direction (left and right direction in FIG. 2).

Communication holes 13 are formed in the base plate 21 at positions each of which overlaps in a plan view with an end portion of one of the pressure chambers 10, the end portion being included in both end portions in the longitudinal direction (left and right direction in FIG. 2) of one of the pressure chambers 10. Communication holes 14 are formed in the base plate 21 at positions each of which overlaps in a plan view with the other end portion in the longitudinal direction of one of the pressure chambers 10. The manifold channel 11 extending in the paper feeding direction is formed in the manifold plate 22. The manifold channel 11 is arranged to overlap with the left halves of the pressure chambers 10 arranged on the left side and with the right halves of the pressure chambers 10 arranged on the right side in FIG. 2. Ink is supplied to the manifold channel 11 from an ink supply port 9. Further, communication holes 15 are formed in the manifold plate 22 at positions each overlapping with one of the communication holes 14 in a plan view.

The nozzles 16 are formed in the nozzle plate 23 at positions each of which overlaps with one of the communications hole 15 in a plan view. When the nozzle plate 23 is made of a synthetic resin material, the nozzles 16 can be formed by a method such as an excimer laser process, and when the nozzle plate 23 is made of a metallic material, the nozzles 16 can be formed by a method such as press working.

Further, the manifold channel 11 communicates with each of the pressure chambers 10 via one of the communication holes 13, and each of the pressure chambers 10 further communicates with one of the nozzles 16 via the communication holes 14 and 15. Thus, in the channel unit 31, a plurality of individual ink channels each from the manifold channel 11 up to one of the nozzles 16 via one of the pressure chambers 10 is formed.

Next, the piezoelectric actuator 32 will be explained below. The piezoelectric actuator 32, as shown in FIG. 4 and FIG. 5, includes a vibration plate 40 formed on the upper surface of the channel unit 31, a piezoelectric layer 41 formed on the upper surface of the vibration plate 40, and a plurality of individual electrodes 12 formed on the upper surface of the piezoelectric layer 41, corresponding to the pressure chambers 10 respectively.

The vibration plate 40 is a plate having a substantially rectangular shape in a plan view, and is made of a metallic material such as an iron alloy like stainless steel, a copper alloy, a nickel alloy, or a titanium alloy. The vibration plate 40 is arranged on the upper surface of the cavity plate 20 to cover the openings of the pressure chambers 10, and is joined to the upper surface of the cavity plate 20. The vibration plate 40 is electroconductive, and also serves as a common electrode which generates an electric field in a portion of the piezoelectric layer 41 sandwiched between the vibration plate 40 and the individual electrodes 12.

On the upper surface of the vibration plate 40, as shown in FIG. 4, the piezoelectric layer 41 mainly composed of lead zirconate titanate (PZT) which is a solid solution of lead titanate and lead zirconate, and is a ferroelectric substance, is arranged. The piezoelectric layer 41 is formed continuously across (over) the pressure chambers 10, except in an area overlapping with a portion in which the manifold channel 11 is extended in the left and right direction in FIG. 2, and with a top-left corner portion of the vibration plate 40. The piezoelectric layer 41 can be formed by an aerosol deposition method (AD method) in which very fine particles of a piezoelectric material are blown onto a substrate and collided to the substrate at high velocity, to be deposited onto the substrate. Alternatively, the piezoelectric layer 41 can also be formed, for example, by a method such as a sputtering method, a chemical vapor deposition method (CVD method), a sol-gel method, or a hydrothermal synthesis method. Still alternatively, the piezoelectric layer 41 can also be formed by cutting, to a predetermined size, a piezoelectric sheet which is prepared by baking a green sheet of PZT, and sticking the cut piezoelectric sheet or sheets to the vibration plate 40.

Each of the individual electrodes 12 are formed in the upper surface of the piezoelectric layer 41 to have an elliptic shape in a plan view and be smaller in size to some extent than one of the pressure chambers 10. Further, the individual electrodes 12 are made of an electroconductive material such as gold, copper, silver, palladium, platinum, or titanium. Furthermore, each of the individual electrodes 12 has an area (main area, first area) which overlaps in a plan view with one of the pressure chambers 10, and an area (connecting area, second area) not overlapping with the pressure chamber 10. Moreover, in each of the individual electrodes 12, one end thereof in the longitudinal direction extends up to the connecting area, and this extended portion on the one end is a contact point 12*a*. The individual electrodes 12 can be formed by, for example, a screen printing, the sputtering method, a vapor deposition method, or the like.

On the upper surface of the piezoelectric actuator 32, as shown in FIGS. 2 to 6, the FPC 33 is arranged. The FPC 33 includes a substrate 42 which is made of a synthetic resin material having an insulating property and is arranged on the upper surface of the piezoelectric layer 41, wirings (first wirings) 43 which are formed on an upper surface of the substrate 42 and each of which is connected to the contact point 12a of one of the individual electrodes 12, and a wiring 46 connected to the vibration plate 40.

A plurality of through holes (first through holes) 42*a* is formed in the substrate 42, at positions overlapping with the contact points 12*a* respectively in a plan view. Further, a plurality of through holes (second through holes) 42*b* are formed in an area of the substrate 42, the area overlapping in a plan view with a between-rows area and with outside-rows areas in the piezoelectric actuator 32. Here, the between-rows area in the piezoelectric actuator 32 is an area of the piezoelectric layer 41 which overlaps in a plan view with an area between the rows of the pressure chambers 10 arranged in two rows, but not overlaps with the pressure chambers 10 in a plan view. The outside-rows areas in the piezoelectric actuator 32 is areas of the piezoelectric layer 41, each of which overlaps with an area between pressure chambers 10 which are included in one of the two rows of the pressure chambers 10 and which are adjacent to each other in the paper feeding direction (up and down direction in FIG. 2), and each of which overlaps with an area outside in the scanning direction (left and right direction in FIG. 2) of the area formed with one of the through holes 42*a*. The diameter of each of the through holes 42*a* and 42*b* is about 30 μm to 40 μm, and the through holes 42*a* and 42*b* are formed such that an inner diameter of the holes 42*a* and 42*b* is decreased progressively toward a lower-surface side (side of the piezoelectric layer 41) of the substrate 42.

As shown in FIGS. 2 to 4, an electroconductive material 44 is filled in each of the through holes 42*a*. The electroconductive material 44 is joined (connected) to the wirings 43 and the contact points 12*a* of the individual electrodes 12, and a contact point 43*a* of each of the wirings 43, and one of the individual electrodes 12 are electrically connected via the electroconductive material 44. As it will be described later, the electroconductive material 44 is filled in the through hole 42*a* by jetting, from a position above the substrate 42, a melted solder or a nano electroconductive particle ink including nano particles, for example, of a material such as silver and/or gold, etc. In each of the through holes 42*b*, a fixing material 45 is filled. The fixing material 45 is joined (adhered) to the substrate 42 and the piezoelectric layer 41, and the substrate 42 and the piezoelectric layer 41 are mechanically connected by the fixing material 45. As will be described later, the fixing material 45 is filled in the through hole 42*b* by jetting a material such as a UV (ultraviolet) curable resin, an epoxy resin or the like from the position above the substrate 42.

As shown in FIGS. 2 and 6, each of the wirings 43 is extended, from the contact point 43*a* overlapping with one of the through holes 42*a* of the substrate 42, toward a side opposite to the center of the substrate 42 in the scanning direction, and is bent in a direction from the ink supply port 9 toward a driver IC 50 in the paper feeding direction (upward direction in FIG. 2). Further, each of the wirings 43 is bent toward the center of the substrate 42 in the scanning direction, and is extended up to the driver IC 50 arranged on the upper surface of the FPC 33. Furthermore, the driver IC 50 sets a desired individual electrode 12 to a predetermined electric potential, via the wiring 43 and the electroconductive material 44. The wiring 46, as shown in FIGS. 2 and 6, is extended in a direction from one corner portion of the substrate 42 (top-left corner portion in FIG. 2) toward the center of the substrate 42 in the scanning direction (right side in FIG. 2). Further, the wiring 46 is bent in a direction from the driver IC 50 in the paper feeding direction toward the ink supply port 9 (downward direction in FIG. 2), and is connected to the driver IC 50. Further, a contact point 46*a* is provided to the wiring 46 at a portion thereof facing the top-left corner portion of the substrate 42 in FIG. 2, and at the contact point 46*a*, the wiring 46 and the vibration plate 40 are electrically connected. Furthermore, the driver IC 50 keeps an electric potential of the vibration plate 40, which serves also as the common electrode, at a ground potential all the time, via the wiring 46.

Next, an action of the piezoelectric actuator 32 will be explained. When the electric potential of the individual electrodes 12 is selectively set by the driver IC 50, an electric potential difference is generated between the individual electrode 12 and the vibration plate 40 serving as the common electrode, and an electric field in a direction of thickness of the piezoelectric layer 41 is generated in a portion of the piezoelectric layer 41 sandwiched between the individual electrode 12 and the vibration plate 40. At this time, when a direction in which the piezoelectric layer 41 is polarized is same as the direction of the electric field, the piezoelectric layer 41 is contracted in a horizontal direction orthogonal to the thickness direction. Accompanying with the contraction of the piezoelectric layer 41, the vibration plate 40 is deformed to project toward the pressure chamber 10. Therefore, a volume of the vibration plate 10 is decreased, and a pressure in the pressure chamber 10 is increased. As a result, ink is discharged from a nozzle 16 communicating with the pressure chamber 10.

Next, a producing method of the ink-jet head 3 will be explained with reference to FIG. 7A to FIG. 7F. FIGS. 7A to 7F are diagrams showing a producing process of the ink-jet head 3. In the following, a producing process after the formation of the vibration plate 40 on the upper surface of the channel unit 31 will be explained.

Figure 7A:
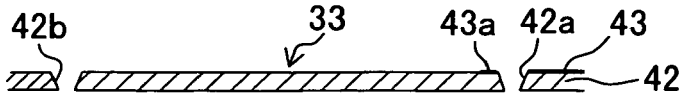
FIG. 7 (FIG. 7A to FIG. 7F) is a process diagram showing producing process of the ink-jet head in FIG. 2.

For producing the ink-jet head 3, after forming the channel unit 31 and forming the vibration plate 40 on the upper surface of the channel unit 31, as shown in FIG. 7A, through holes 41*a* and 42*b* are formed in the substrate 42 having wirings 43 formed on the upper surface thereof, so as to form the FPC 33 (wiring section forming step). Here, each of the through holes 42*a* is formed in an area (first through hole forming area) of the substrate 42 overlapping with the contact point 12*a* of one of the individual electrodes 12 in a plan view when the FPC 33 is arranged on the upper surface of the piezoelectric layer 41 in the subsequent step. In other words, each of the through holes 42*a* is formed in the area of the substrate 42 on which the contact point 43*a* is formed. Each of the through holes 42*b* is formed in an area of the substrate 42 overlapping in a plan view with the between-rows area in the piezoelectric actuator 32 and is formed in an area overlapping in a plan view one of the outside-rows areas in the piezoelectric actuator 32 when the FPC 33 is arranged on the upper surface of piezoelectric layer 41 in the subsequent step. Here, the between-rows area in the piezoelectric actuator 32 is an area which overlaps in a plan view with an area between the rows of the pressure chambers 10 arranged in two rows, but not overlaps with the pressure chambers 10 in a plan view; and the outside-rows areas in the piezoelectric actuator 32 is areas each of which overlaps with an area between pressure chambers 10 which are included in one of the two rows of the pressure chambers 10 and which are adjacent to each other in the paper feeding direction), and each of which is an area outside, in the scanning direction, of the area formed with one of the through holes 42*a*.

Figure 7B:
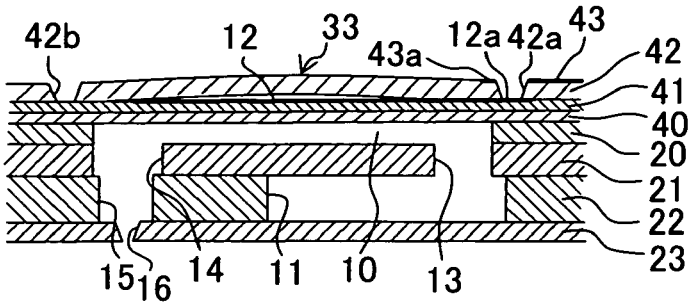

Next, as shown in FIG. 7B, the FPC 33 is positioned such that the contact points 12*a* and the through holes 42*a* formed in the FPC 33 overlap respectively in a plan view, and the FPC 33 is arranged on the upper surface of the piezoelectric layer 41 (wiring section arranging step). At this time, each of the areas in which one of the through holes 42*b* of the FPC 33 is formed is arranged such that the area overlaps in plan view with the between-rows area or the outside-rows area of the piezoelectric layer 41.

Figure 7C:
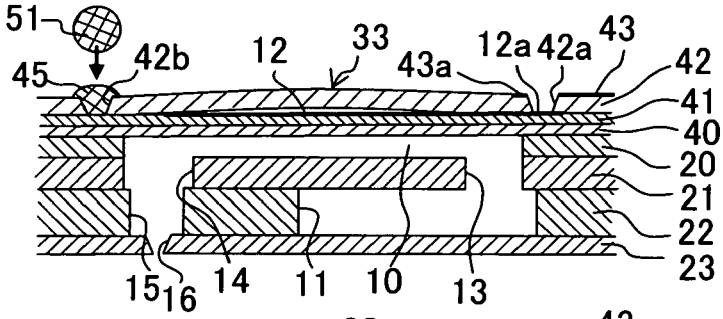

Next, as shown in FIG. 7C, by using an ink-jet head or a micro dispenser, a liquid droplet 51 of a fixing material having a diameter of about 50 μm and being made of a material such as an UV curable resin, an epoxy resin or the like is jetted, from a position above the FPC 33, toward each of the areas in which one of the through holes 42*b* of the FPC 33 is formed, and the fixing material 45 is filled in each of the through holes 42*b* (fixing liquid droplet jetting step).

Figure 7D:
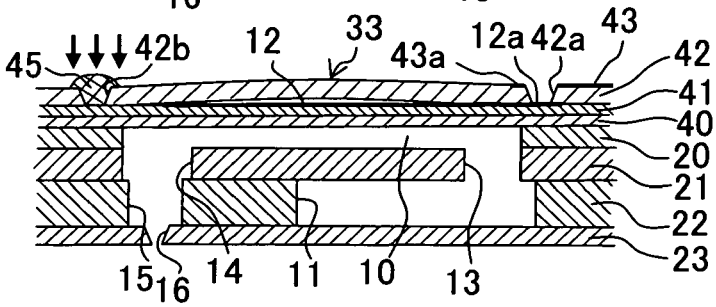

Next, as shown in FIG. 7D, the fixing material 45 filled in each of the through holes 42*b* is cured (fixing liquid droplet curing step). Here, when the fixing material 45 is a UV curable resin, the fixing material 45 is cured by irradiating ultraviolet rays with, for example, an UV lamp, and when the fixing material 45 is an epoxy resin, the fixing material 45 is cured by heating with, for example, an infrared lamp.

Figure 7E:
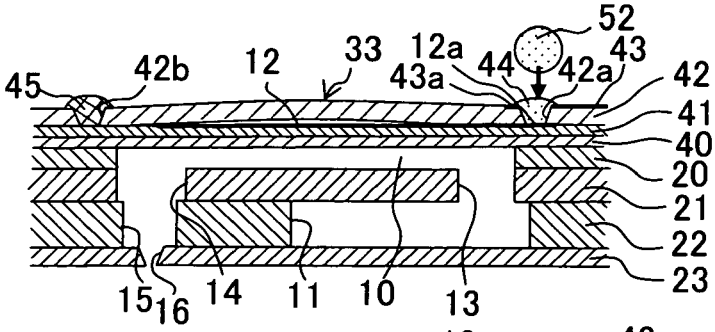

Next, as shown in FIG. 7E, the electroconductive material 44 is filled in each of the through holes 42*a* by jetting, from a position above the FPC 33, a liquid droplet 52 of the electroconductive material in the through hole 42*a* with the ink-jet head or the micro dispenser, the liquid droplet 52 of the electroconductive material having a diameter of about 50 μm and being made of a material such as the melted solder or the nano electroconductive particle ink including nano particles of a material such as silver and/or gold, etc (electroconductive material jetting step).

Figure 7F:
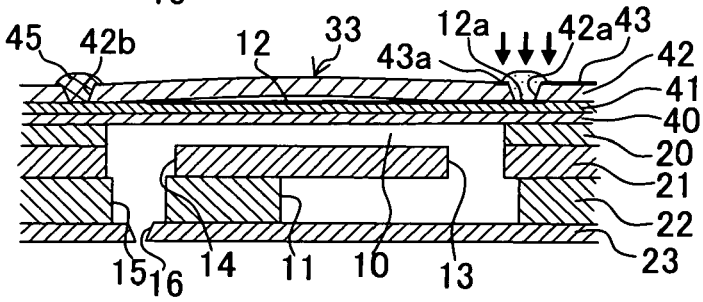

Next, as shown in FIG. 7F, the electroconductive material 44 filled in each of the through holes 42*a* is cured (electroconductive material curing step). Here, when the electroconductive material 44 is the nano particle ink including the nano particles of, for example, silver and/or gold, etc, the electroconductive material 44 is cured by heating with, for example, the infrared lamp, and when the electroconductive material 44 is the solder, the electroconductive material 44 is cured by waiting for a temperature of the solder to be lowered (is cured by allowing the solder to cool down). Afterwards, the vibration plate 40 and the wiring 46 are electrically connected by soldering upon pressing a portion of the substrate 42, in which the contact point 46a of the wiring 46 is formed, against the vibration plate 40, thereby completing the production of the ink-jet head 3.

According to the first embodiment described above, the FPC 33, having the substrate 42 in which the through holes 42*a* and 42*b* are formed, is arranged on the upper surface of the piezoelectric layer 41; the liquid droplet 51 of the fixing material is jetted toward the areas of the substrate 42 (FPC 33) in which the through holes 42*b* are formed respectively so as to fill the fixing material 45 in the through holes 42*b*, and then the fixing material 45 is cured; the liquid droplet 52 of the electroconductive material is jetted toward the areas of the substrate 42 in which the through holes 42*a* are formed respectively so as to fill the electroconductive material in the through holes 42*a*, and then the electroconductive material 44 is cured. Since it is possible, with such a simple method, to mechanically connect the substrate 42 of the FPC 33 and the piezoelectric layer 41 and to connect electrically the wirings 43 of the FPC 33 and the individual electrodes 12, the producing process of the ink-jet head 3 is simplified. Further, since it is not necessary to apply pressure to the piezoelectric layer 41 at the time of connecting the FPC 33 to the piezoelectric layer 41, there is no fear that the piezoelectric layer 41 is damaged due to the pressure applied to the piezoelectric layer 41. Furthermore, in addition to the electroconductive material 44, the fixing material 45 also contributes to the joining of the FPC 33 and the piezoelectric layer 41. Accordingly, as compared to a case in which the FPC 33 and the piezoelectric layer 41 are joined only by the electroconductive material 44, the joining strength of the FPC 33 and the piezoelectric layer 41 is enhanced, and thus the electric connection by the electroconductive material 44 is hardly broken (disengaged).

Further, in the scanning direction, a part of the through holes 42*b* is formed in an area outside of the area in which the through holes 42*a* are formed. Therefore, when an external force is exerted which would exfoliate the FPC 33 along the scanning direction, a stress greater than a stress applied to the electroconductive material 44 filled in the through hole 42*a* is applied to the fixing material 45 filled in the through hole 42*b* formed in the area outside of the through hole 42*a* in the scanning direction. In other words, the joining of the wirings 43 of the FPC 33 and the individual electrodes 12 formed on the piezoelectric layer 41 by the electroconductive material 44 filled in the through holes 42*a* is protected by the fixing material 45 filled in the through holes 42*b*. Therefore, the electric connection between the wirings 43 and the individual electrodes 12 is hardly broken (disengaged).

Further, an inner surface of the substrate 42 defining each of the through holes 42*a* and an inner surface of the substrate 42 defining each of the through holes 42*b* are tapered surfaces tapered toward the piezoelectric layer 41 (lower side). Therefore, by making the liquid droplet of the electroconductive material and the liquid droplet of the fixing material flow along the inner surfaces of the substrate 42 defining the through holes 42*a* and 42*b*, respectively, the electroconductive material 44 and the fixing material 45 can be filled assuredly in the through holes 42*a* and 42*b*, respectively.

Further, the fixing liquid droplet jetting step and the fixing liquid droplet curing step are performed before the electroconductive liquid droplet jetting step and the electroconductive liquid droplet curing step. Therefore, even when a jig holding (fixing) the piezoelectric layer 41 and the substrate 42 is removed after mechanically connecting the piezoelectric layer 41 and the substrate 42 in the fixing liquid droplet jetting step and the fixing liquid droplet curing step, there is no fear that the positions of the piezoelectric layer 41 and the substrate 42 are shifted. Therefore, it is possible to perform the electroconductive liquid droplet jetting step and the electroconductive liquid droplet curing step, after the fixing liquid droplet jetting step and the fixing liquid droplet curing step and after removing the jig or the like fixing the piezoelectric layer 41 and the substrate 42. Therefore, in a case of producing a plurality of ink-jet heads, while the electroconductive liquid droplet jetting step and the electroconductive liquid droplet curing step are performed for a certain ink-jet head, another ink-jet head next to the certain ink-jet head can be produced by using the fixing jig or the like which has been removed from the certain ink-jet head.

Next, modified embodiments in which various changes are made to the embodiment will be explained. Same reference numerals will be given to parts or components having similar construction as those in the embodiment, and explanation therefore will be omitted as appropriate.

First Modified Embodiment

Figure 8:
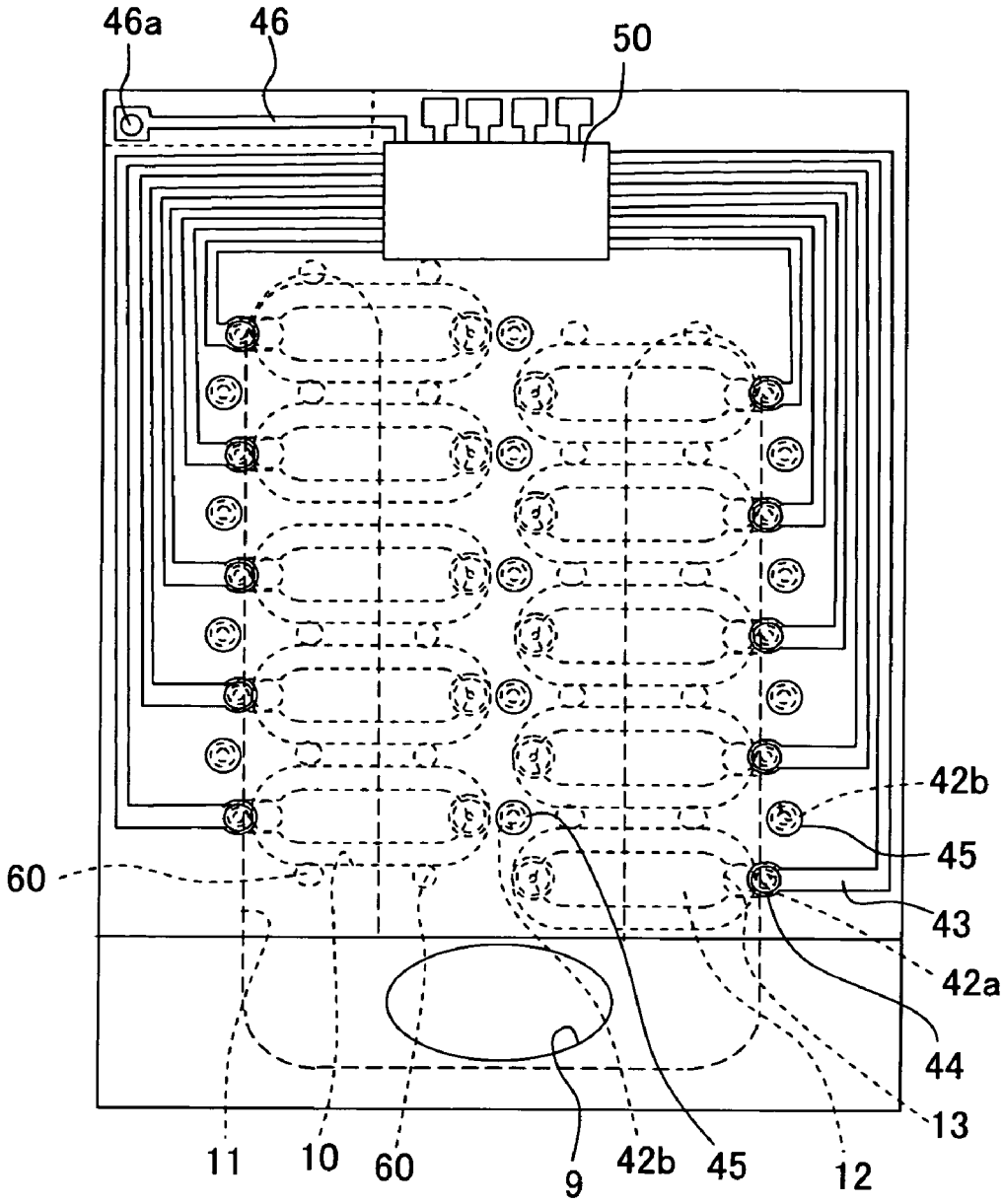
FIG. 8 is a plan view according to a first example of a first modified embodiment, corresponding to FIG. 2.
Figure 8:
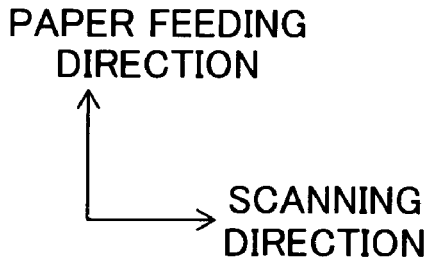
Figure 9:
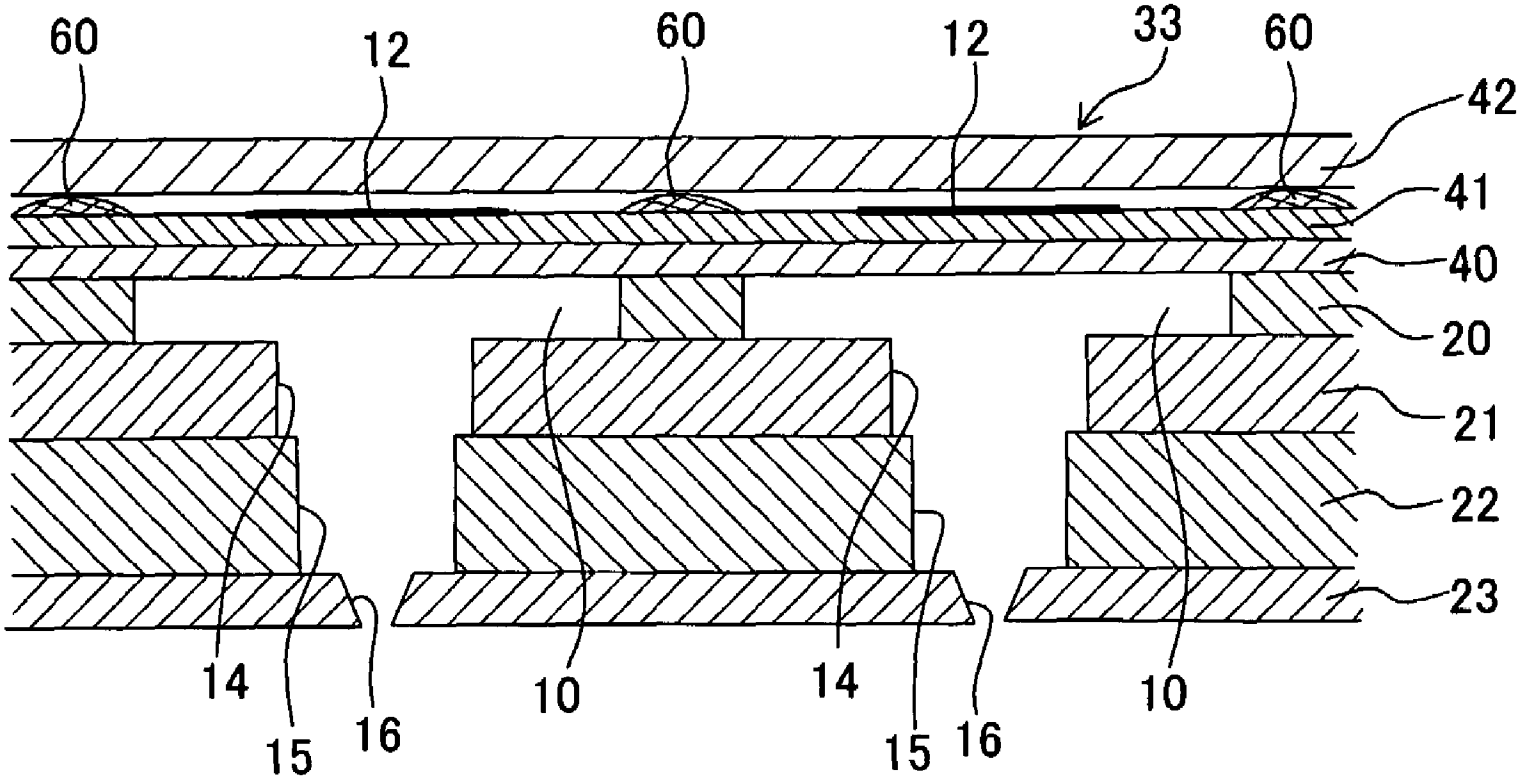
FIG. 9 is a cross-sectional view according to the first example of the first modified embodiment, corresponding to FIG. 5.

As a first example of the first modified embodiment, as shown in FIGS. 8 and 9, projections 60 made of an epoxy resin and projecting upward may be formed on a surface of the piezoelectric layer 41 in areas each of which is between the adjacent pressure chambers 10 in the paper feeding direction and which does not overlap with one of the pressure chambers 10. In this case, gaps are defined, due to the projections 60, between the piezoelectric layer 41 and the FPC 33, in areas of the piezoelectric layer 41 overlapping in a plan view with the pressure chambers 10 respectively. Due to the gaps, the piezoelectric layer 41 and the FPC 33 are prevented from making a contact with each other. Accordingly, it is possible to prevent the FPC 33 from making a contact with the area or areas of the piezoelectric layer 41 in the area overlapping with the pressure chamber or chambers 10, and affecting discharge characteristics of ink. It is possible to form such projections by performing a step of forming the projections 60 on the upper surface of the piezoelectric layer 41 (projection forming step), before arranging the FPC 33 on the upper surface of the piezoelectric layer 41 in the arranging step.

Figure 10:
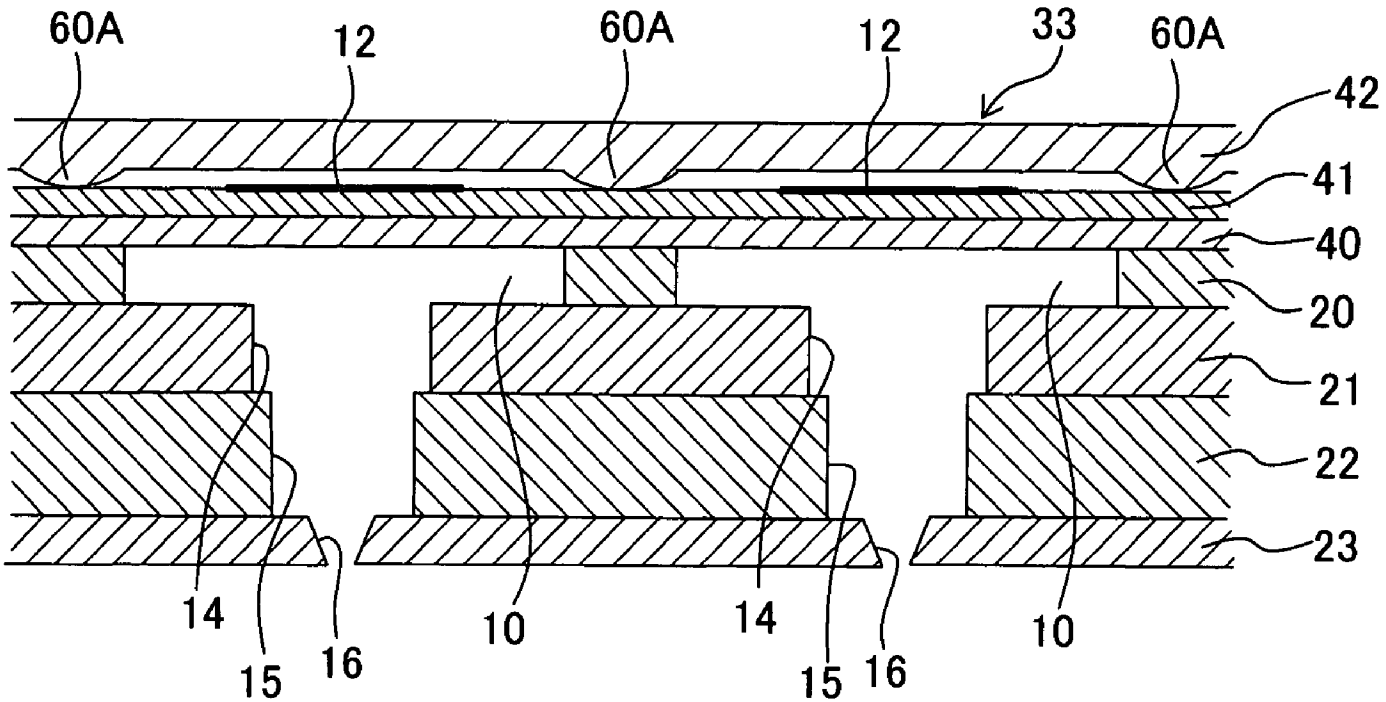
FIG. 10 is a cross-sectional view according to a second example of the first modified embodiment, corresponding to FIG. 5.

As a second example, in addition to forming the projections 60 on the upper surface of the piezoelectric layer 41, or instead of forming the projections 60 on the upper surface of the piezoelectric layer 41, projections 60A projecting downward may be formed in areas on a lower surface of the FPC 33 (on a surface facing the piezoelectric layer), the areas not overlapping in a plan view with the pressure chambers 10 respectively, as shown in FIG. 10. Accordingly, similarly as in a case of the projections 60, it is possible to prevent the FPC 33 from making a contact in the area(s) of the piezoelectric layer 41 overlapping with the pressure chamber(s) 10, and affecting the discharge characteristics of the ink. Such projection 60A may be formed on a lower surface of the FPC 33 with a material such as an epoxy resin, or may be formed by subjecting the FPC 33 to plastic deformation by embossing (stamping) on the FPC 33 by a punch or the like.

Second Modified Embodiment

Figure 11:
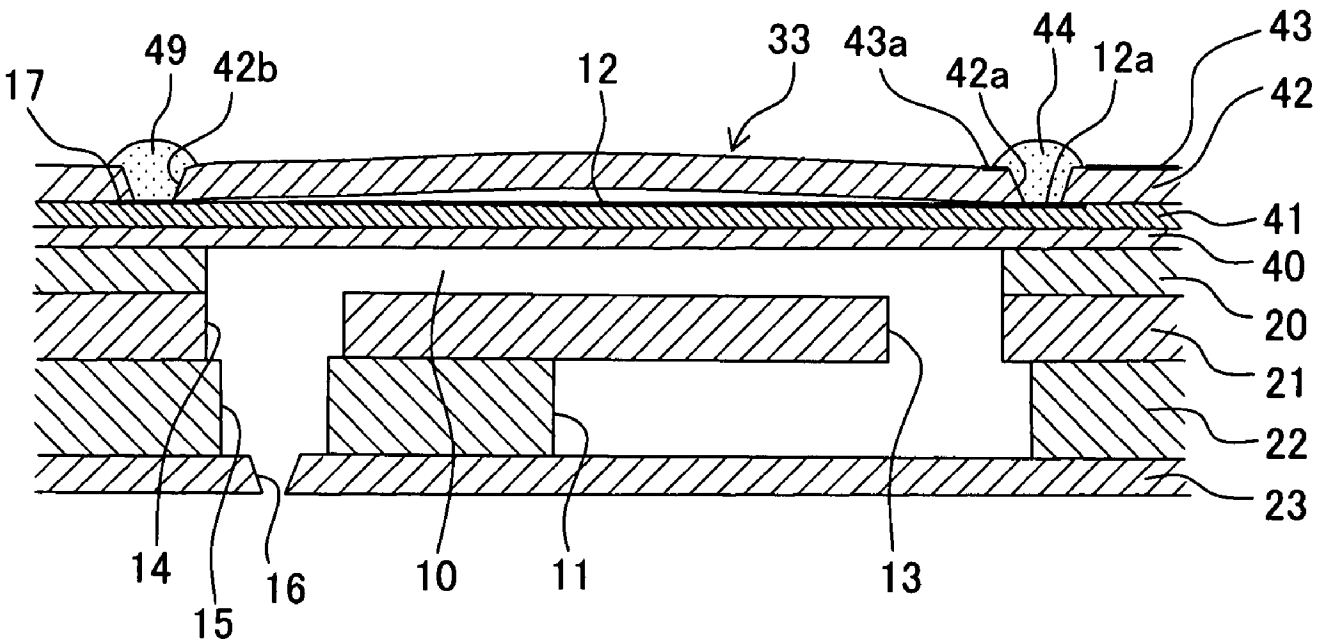
FIG. 11 is a cross-sectional view of a second modified embodiment, corresponding to FIG. 4.

As shown in FIG. 11, a dummy electrode 17 which is insulated from the individual electrode 12, may be formed in an area of the piezoelectric layer 41, the area overlapping with one of the through holes 42*b* in a plan view, and an electroconductive material 49 may be filled in the through hole 42*b*. Even in this case, the piezoelectric layer 41 and the substrate 42 are mechanically connected by the electroconductive material 49. Here, since the electroconductive material 49 is joined to the dummy electrode 17 formed on the surface of the piezoelectric layer 41, the joining strength is enhanced as compared to a case in which the electroconductive material 49 is filled in the through hole 49*b* without forming the dummy electrode 17. Furthermore, when the electroconductive material 49 and the electroconductive material 44 are made of the same material, it is possible to form the electroconductive material 44 and the electroconductive material 49 in the same step, and then to cure the electroconductive materials 44 and 49 at the same time, thereby simplifying the producing process.

Second Embodiment

A second embodiment according to the present invention will be explained below. In the second embodiment, since a structure of the vibration plate and the piezoelectric layer differs from the structure in the first embodiment, the difference will be particularly explained below in detail.

Figure 12:
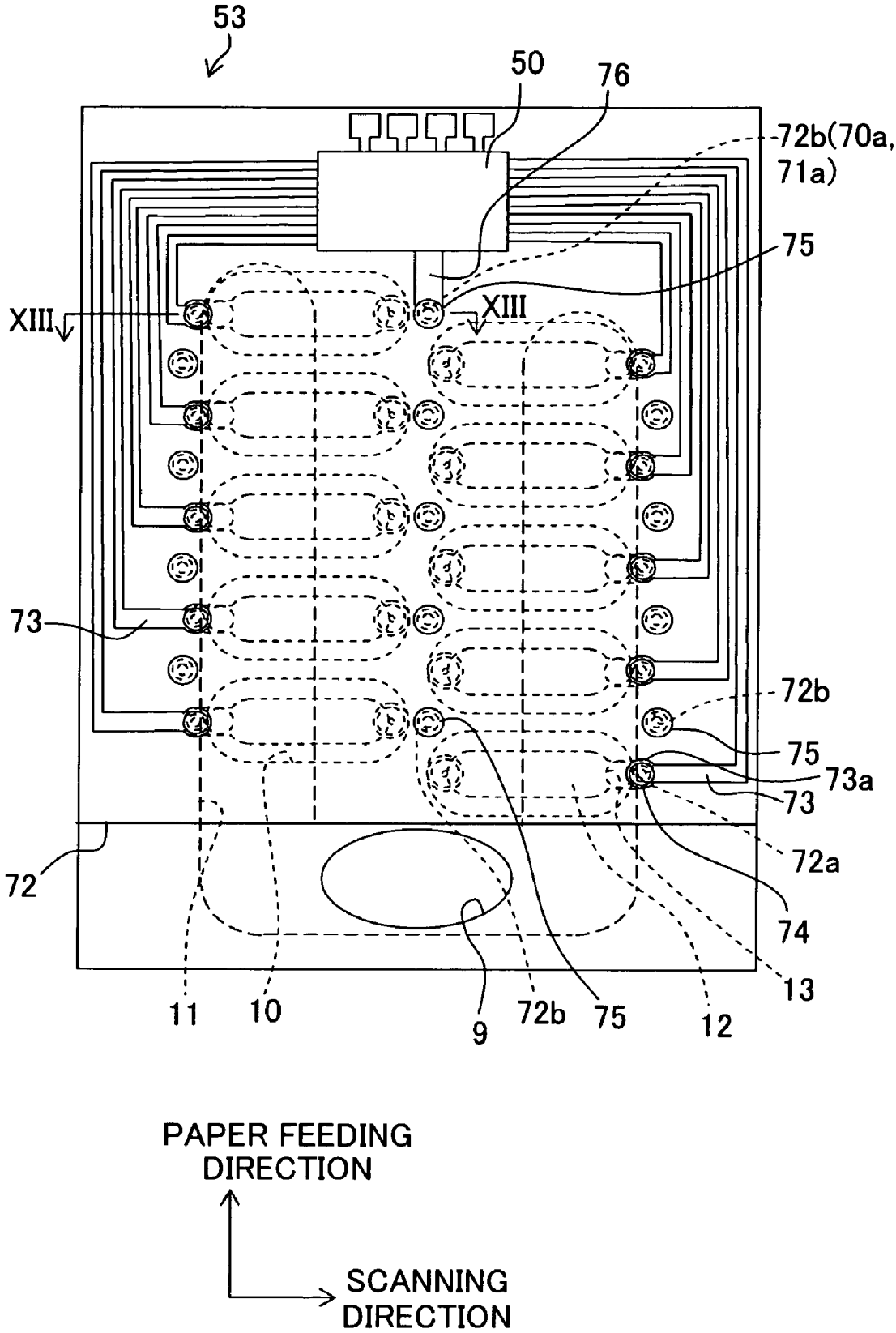
FIG. 12 is a plan view of an ink-jet head according to a second embodiment of the present invention.
Figure 13:
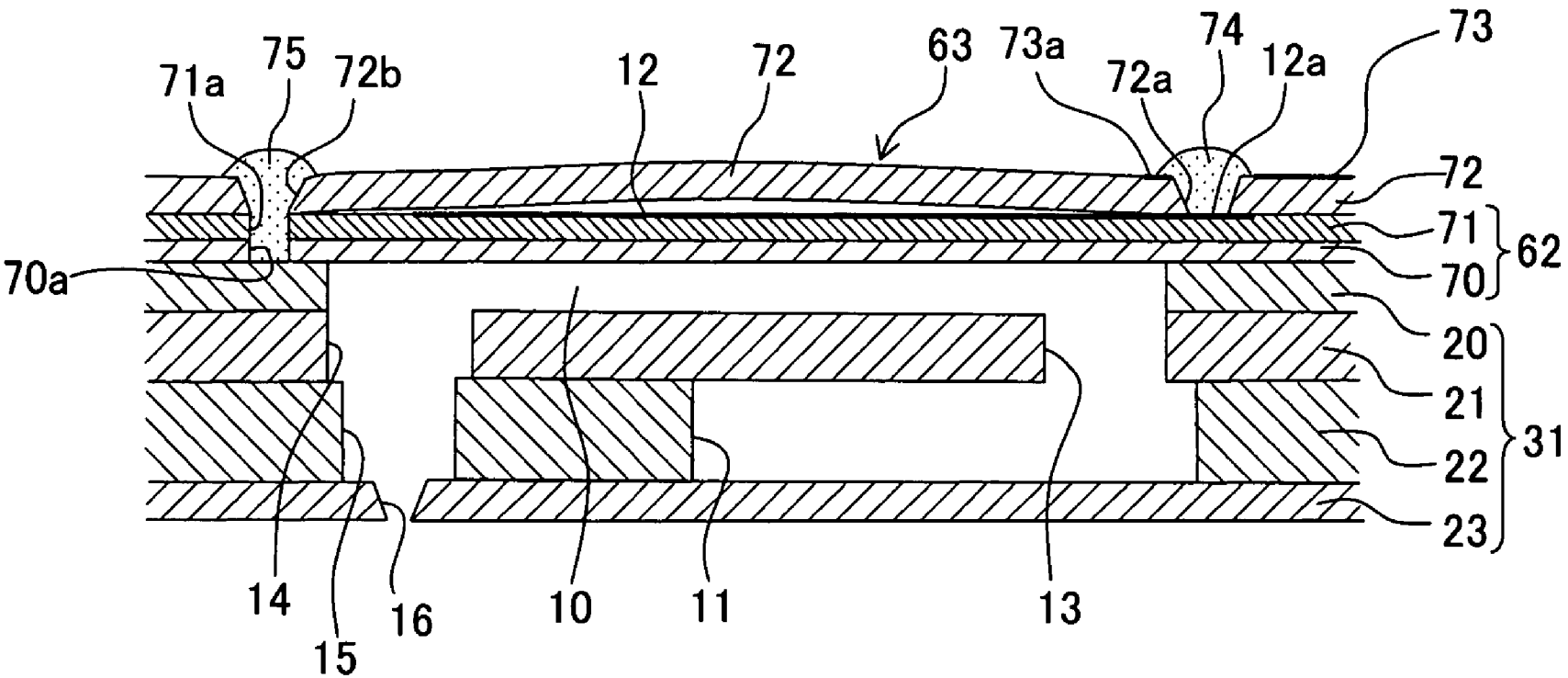
FIG. 13 is a cross-sectional view taken along a line XIII-XIII shown in FIG. 12.

FIG. 12 is a plan view of an ink-jet head 53 according to the second embodiment. FIG. 13 is a cross-sectional diagram taken along a line XIII-XIII shown in FIG. 12. As shown in FIGS. 12 and 13, the ink-jet head 53, similar to the ink-jet head 3 in the first embodiment, includes the channel unit 31 in which the individual channels each including the pressure chamber 10 are formed; a piezoelectric actuator 62 arranged on the upper surface of the channel unit 31; and an FPC 63 arranged on the upper surface of the piezoelectric actuator 62.

The channel unit 31 is similar to the channel unit in the first embodiment, and includes four plates, namely a cavity plate 20, a nozzle plate 21, a manifold plate 22, and a nozzle plate 23 which are stacked and joined in the stacked form (layers). Further, similarly as in the first embodiment, a plurality of individual ink channels each from the manifold channel 11 to one of the nozzles 16 via one of the pressure chambers 10 is formed.

The piezoelectric actuator 62, as shown in FIG. 13, includes a vibration plate 70 which is formed on the upper surface of the channel unit 31, a piezoelectric layer 71 which is formed on an upper surface of the vibration plate 70, and a plurality of individual electrodes 12 formed on an upper surface of the piezoelectric layer 71, corresponding to the pressure chambers 10 respectively.

The vibration plate 70, similar to the vibration plate 40 in the first embodiment (see FIG. 4), is a stainless steel plate having a substantially rectangular shape in a plan view. The vibration plate 70 is arranged on the upper surface of the cavity plate 20 so as to cover the pressure chambers 10, and is joined to the upper surface of the cavity plate 20. The vibration plate 70 made of a metallic material has an electroconductive property, and serves also as a common electrode which generates an electric field in a portion of the piezoelectric layer 71 sandwiched between the vibration plate 70 and the individual electrode 12. Further, a through hole 70*a* is formed in a portion of the vibration plate 70, the portion being adjacent to a right side portion of a pressure chamber 10 which is included in the pressure chambers 10 and is the top-leftmost pressure chamber among the pressure chambers 10 in FIG. 11, and the portion not overlapping in a plan view with any of the pressure chambers 10.

On the upper surface of the vibration plate 70, as shown in FIG. 13, the piezoelectric layer 71 is arranged. The piezoelectric layer 71 is mainly composed of lead zirconate titanate (PZT) which is a solid solution of lead titanate and lead zirconate, and is a ferroelectric substance. The piezoelectric layer 71 is formed continuously across (over) the pressure chambers 10, except in an area overlapping with a portion in which the manifold channel 11 is extended in the left and right direction in FIG. 12. Further, a through hole 71*a* is formed in an area of the piezoelectric layer 71, overlapping in a plan view with the through hole 70*a* of the vibration plate 70. The piezoelectric layer 71, as will be described later, is formed with a method such as the aerosol deposition (AD) method, or the vapor deposition method, by depositing very fine particles of a piezoelectric material on the upper surface of the vibration plate 70.

Each of the individual electrodes 12 is formed in the upper surface of the piezoelectric layer 71 to have an elliptic shape in a plan view and be smaller in size to some extent than one of the pressure chambers 10. Further, the individual electrodes 12 are made of an electroconductive material such as gold, copper, silver, palladium, platinum, or titanium. Further, each of the individual electrodes 12 has an area (main area) which overlaps with one of the pressure chambers 10, and an area (connecting area) not overlapping with the pressure chamber 10. Furthermore, in each of the individual electrodes 12, one end thereof in the longitudinal direction extends up to the connecting area, and this extended portion on the one end is a contact point 12*a*. The individual electrode 12 can be formed by, for example, a screen printing, the sputtering method, a vapor deposition method, or the like.

On the upper surface of the piezoelectric actuator 62, as shown in FIG. 12, the FPC 63 is arranged. The FPC 63 includes a substrate 72 which is made of a synthetic resin material and is arranged on the upper surface of the piezoelectric layer 71, wirings (first wirings) 73 which are formed on an upper surface of the substrate 72 and each of which is connected to the contact points 12*a* of one of the individual electrodes 12, and a wiring 76 connected to the vibration plate 70.

A plurality of through holes (first through holes) 72*a* is formed in the substrate 72 at the first through hole forming areas respectively. Further, a plurality of through holes (second through holes) 72*b* are formed in an area of the substrate 72, the area overlapping in a plan view with a between-rows area and with outside-rows areas in the piezoelectric actuator 62. The diameter of each of the through holes 72*a* and 72*b* is about 30 μm to 40 μm. Further, an inner surface of the substrate 72 defining each of the through holes 72*a* and an inner surface of the substrate 72 defining each of the through holes 72*b* are tapered surfaces tapered toward the piezoelectric layer 71 (lower side). Furthermore, one through hole 72*b*, among the through holes 72*b*, is communicated with the through holes 70*a* and 71*a*.

As shown in FIGS. 12 and 13, an electroconductive material 74 is filled in each of the through holes 72*a*. The electroconductive material 74 is joined (connected) to each of the wirings 73 and each of the individual electrodes 12, and the wirings 73 and the individual electrodes 12 are electrically connected, respectively, via the electroconductive material 74. An electroconductive material 75 is filled in each of the through holes 72*b*. The electroconductive material 75, filled in the through hole 72*b* included in the through holes 72*b* and communicating with the through holes 70*a* and 71*a*, is joined (connected) to the vibration plate 70 via the through holes 70*a* and 71*a*, and is also joined (connected) to the wiring 76, thereby connecting the vibration plate 70 and the wiring 76 electrically. The electroconductive material 75, filled in each of the through holes 72*b* other than the through hole 72*b* communicating with the through holes 70*a* and 71*a*, is joined (connected) to the substrate 72 and the piezoelectric layer 71, and the substrate 72 and the piezoelectric layer 71 are mechanically connected by the electroconductive material 75.

Each of the wirings 73 is extended, from the contact point 73*a* overlapping with one of the through holes 72*a* of the substrate 72, outwardly in the left or right direction of the substrate 72 in FIG. 12, and is bent in an upward direction in FIG. 12. Further, each of the wirings 73 is bent inwardly in the left or right direction in FIG. 12, and is extended up to the driver IC 50 arranged on the upper surface of the FPC 63. Accordingly, the driver IC 50 applies a predetermined electric potential to a desired individual electrode 12 via the wiring 73 and the electroconductive material 74. The wiring 76 is extended in an upward direction in FIG. 12, from the position formed such that the through hole 72*b* of the substrate 72 and the through holes 70*a*, 71*a* of the actuator 62 are overlapped, and is connected to the driver IC 50. An electric potential of the vibration plate 70 which serves also as the common electrode is maintained at a ground potential all the time by the driver IC 50 via the wiring 46.

Figure 14A:
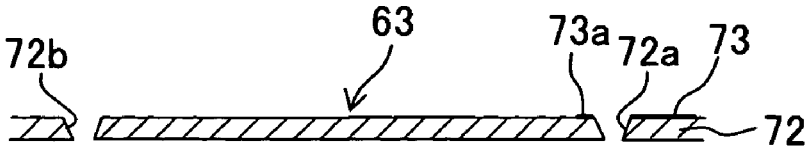
FIG. 14 (FIGS. 14A to 14E) is a process diagram showing a first half of a producing process of the ink-jet head according to the second embodiment.
Figure 14B:
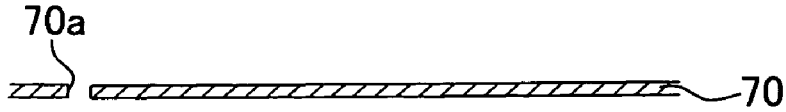
Figure 14C:
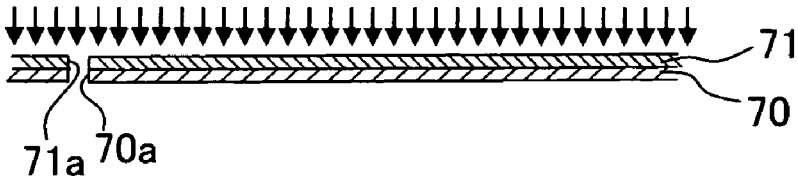
Figure 14D:
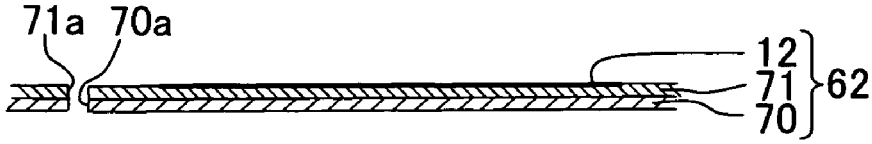
Figure 14E:
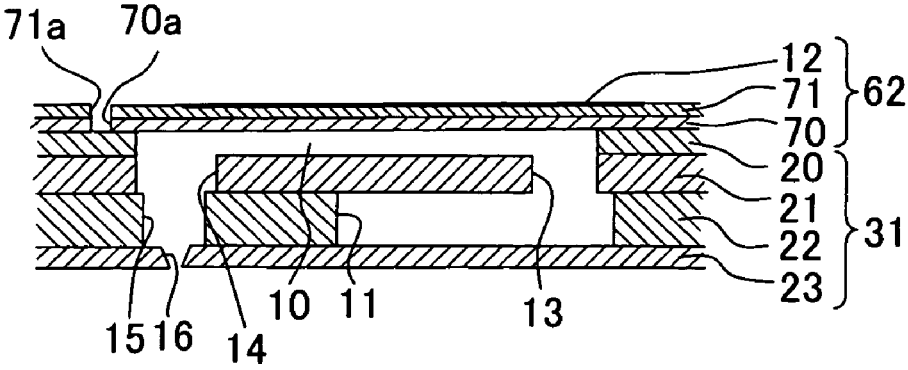
Figure 15A:
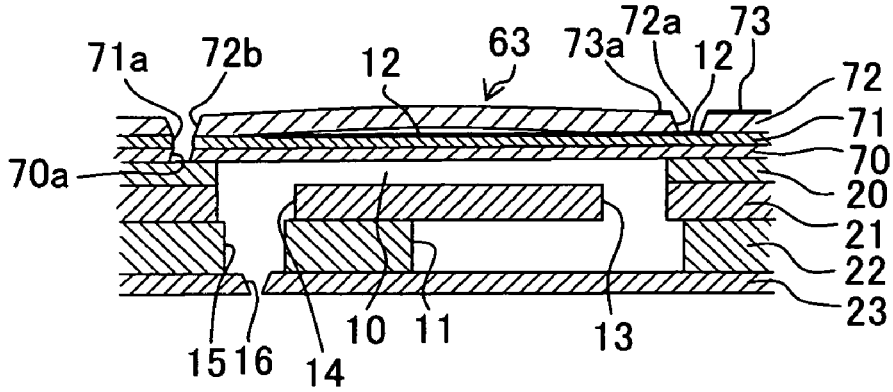
FIG. 15 (FIGS. 15A to 15C) is a process diagram showing a second half of the producing process of the ink-jet head according to the second embodiment.
Figure 15B:
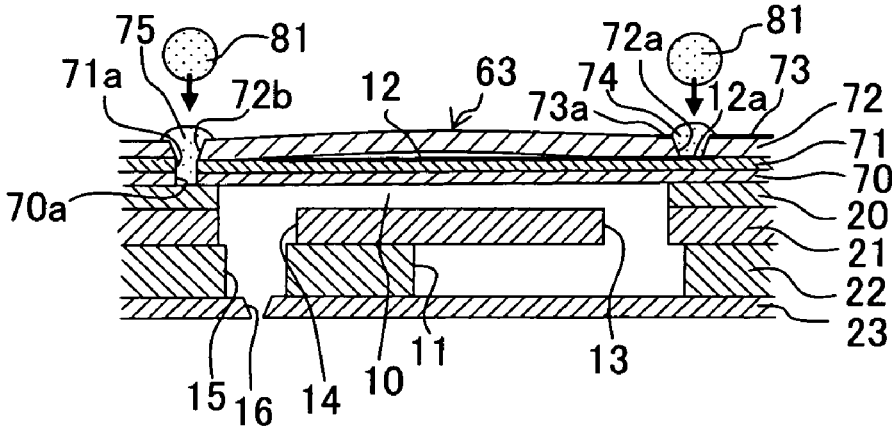
Figure 15C:
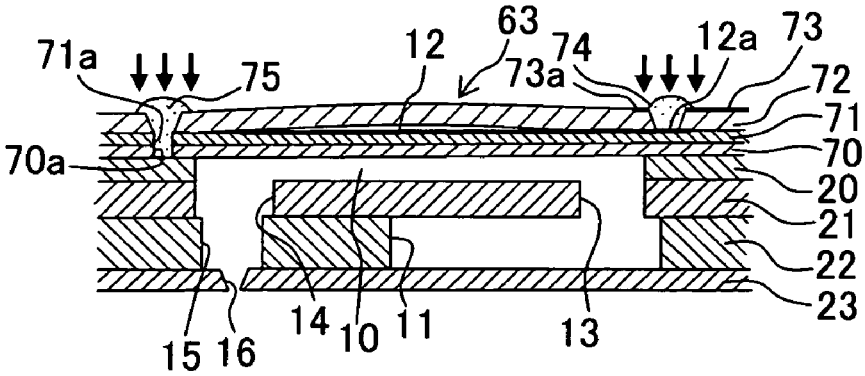

Next, a producing method of the ink-jet head 53 will be explained with reference to FIG. 14 (FIGS. 14A to 14E) and FIG. 15 (FIGS. 15A to 15C). In the producing method of the ink-jet head 53, however, a producing process after producing the channel unit 31 in the producing method of the ink-jet head 53 will be explained. FIG. 14 (FIGS. 14A to 14E) is a process diagram showing a first half of the producing process, and FIG. 15 (FIGS. 15A to 15C) is a process diagram showing a second half of the producing process.

For producing the ink-jet head 53, after producing the channel unit 31, as shown in FIG. 14A, the through holes 72*a* and 72*b* are formed in the substrate 72 on which the wirings 73 and the wiring 76 (see FIG. 12) have been formed, thereby forming the FPC 63 (wiring section forming step). Here, each of the through holes 72*a* is formed in an area (first through hole forming area) which is to overlap in a plan view with the contact point 12*a* of one of the individual electrodes 12 when the substrate is arranged on the upper surface of the piezoelectric actuator 62 in the subsequent step, in other words, in the area which is to overlap with the contact point 73*a*. Each of the through holes 72*b* is formed in an area, of the substrate 72, which is to overlap in a plan view with the between-rows area of the piezoelectric actuator 62 or which is to overlap in a plan view with the outside-row area of the piezoelectric actuator 62 when the substrate 72 is arranged on the upper surface of the piezoelectric actuator 62 in the subsequent step.

Next, the through hole 70*a* is formed in the vibration plate 70 by a press working or the like, as shown in FIG. 14B. At this time, the through hole 70*a* is formed such that the through hole 70*a* overlaps with an area adjacent to a right side portion of the top-leftmost pressure chamber 10 in FIG. 12.

Next, as shown in FIG. 14C, the piezoelectric layer 71 is formed on the upper surface of the vibration plate 70 in which the through hole 70*a* is formed, by a method such as the AD method or the vapor deposition method. At this time, the through hole 71*a* is formed in the area of the piezoelectric layer 71, the area overlapping with the through hole 70*a* of the vibration plate 70 in a plan view.

Next, as shown in FIG. 14D, the individual electrodes 12 are formed on the upper surface of the piezoelectric layer 71 by a method such as the screen printing, the sputtering method, the vapor deposition method, or the like. Each of the individual electrodes 12 is formed in the area of the piezoelectric layer 71 which is to overlap in a plan view with one of the pressure chambers 10 when the piezoelectric actuator 62 is joined to the channel unit 31. Thus, by forming the vibration plate 70, the piezoelectric layer 71, and the individual electrodes 12, the piezoelectric actuator 62 is formed (piezoelectric actuator forming step). Further, as shown in FIG. 14E, the piezoelectric actuator 62 is joined to the upper surface of the cavity plate 20 in the channel unit 31.

Next, as shown in FIG. 15A, the area of the FPC 63 formed with the through hole 72*a* and the contact point 12*a* are positioned to mutually overlap in a plan view, and the FPC 63 is arranged on the upper surface of the piezoelectric layer 71 (wiring section arranging step). At this time, the FPC 63 is arranged such that the through hole 72*b*, of the through holes 72b communicates with the through holes 70*a* and 71*a* formed in the between-rows area of the piezoelectric actuator 62 at the topmost position in FIG. 12. This through hole 72*b* included in the through holes 72*b* and communicating with the through holes 70*a* and 71*a* is referred to as a through hole 72*c*.

Next, as shown in FIG. 15B, by using the ink-jet head, the micro dispenser or the like, a liquid droplet 81 of an electroconductive material, having a diameter of about 50 μm and made of a material such as the melted solder or the nano electroconductive particle ink which includes nano particles of a material such as silver and/or gold etc., is jetted from a position above the FPC 63 toward the areas of the FPC 63 in each of which the through hole 72*a* or 72*b* is formed, thereby filling the electroconductive material 74 in the through holes 72*a* and filling the electroconductive material 75 in the through holes 72*b* (electroconductive material jetting step). At this time, the electroconductive material 75 is filled also in the through holes 70*a* and 71*a*.

Next, as shown in FIG. 15C, the electroconductive material 74 jetted in the through holes 72*a* and the electroconductive material 75 jetted in the through holes 72*b* are cured (electroconductive material curing step). Here, when the electroconductive materials 74 and 75 are a nano electroconductive particle ink including nano particles of, for example, silver and/or gold etc., the electroconductive materials 74 and 75 can be cured by heating, for example, with an infrared lamp. When the electroconductive materials 74 and 75 are a solder, the electroconductive materials 74 and 75 can be cured, for example, by waiting for the temperature of the solder to be lowered (can be cured by allowing the solder to cool down). Thus, through the steps described above, the ink-jet head 3 is produced.

According to the second embodiment explained above, the FPC 63 having the substrate 72 formed with the through holes 72*a* and the through holes 72*b* is arranged on the upper surface of the piezoelectric layer 71; the liquid droplet 81 of the electroconductive material is jetted toward the area of the substrate 72 each formed with the through hole 72*a* or 72*b* in order to fill the electroconductive materials 74 and 75 in the through holes 72*a* and 72*b*, respectively; and the electroconductive materials 74 and 75 are cured. Thus, with such a simple method, it is possible to mechanically connect the piezoelectric layer 71 and the substrate 72 of the FPC 63, and to electrically connect the wirings 73 of the FPC 63 and the individual electrodes 12 and to electrically connect the wiring 76 of the FPC 63 and the vibration plate 70. Therefore, the producing method of the ink-jet head 53 is simplified. Further, it is not necessary to apply pressure to the piezoelectric layer 71 while performing the connection for the FPC 63. Therefore, it is possible to prevent damage to the piezoelectric layer 71 which would be otherwise caused due to the applied pressure.

Further, a part of (some of) the through holes 72*b* is (are) formed in areas, of the FPC 63, which are outside in the scanning direction of the areas in which the through holes 72*a* are formed respectively, and in an area of the FPC 63, the area being outside in the scanning direction of the area in which the through hole 72*c* is formed. Therefore, when an external force in a direction to exfoliate the FPC 63 along the scanning direction is exerted, a stress greater than a stress applied to the electroconductive material 74 filled in each of the through holes 72*a* and to the electroconductive material 75 filled in the through hole 72*b* (through hole 72*c*) communicating with the through holes 70*a* and 71*a*, is applied to the electroconductive material 75 filled in the through holes 72*b* other than the through hole 72*c*. Accordingly, the electric connection between the wirings 73 and the individual electrodes 12, and between the wiring 76 and the vibration plate 70 is hardly broken or disengaged.

Further, since it is possible to form the electroconductive material 74 and the electroconductive material 75 in the same step, the producing process is simplified.

Furthermore, the through hole 71*a* is formed concurrently with the forming of the piezoelectric layer 71 by the AD method or the vapor deposition method on the surface of the vibration plate 70 in which the through hole 70*a* has been formed. Therefore, any step for separately forming the through hole 71*a* is not necessary, and the producing process is simplified.

Further, in the electroconductive liquid droplet jetting step, the individual electrode 12 and the wirings 73 are electrically connected by the electroconductive material 74 filled in each of the through holes 72*a*, and the vibration plate 70 and the wiring 76 are electrically connected by the electroconductive material 75 filled in the through hole 72*c*. Therefore, it is not necessary to provide a separate step for electrically connecting the vibration plate 70 and the wiring 76, and the producing process is further simplified.

Further, similarly as in a case of the first embodiment, an inner surface of the substrate 72 defining each of the through holes 72*a* and an inner surface of the substrate 72 defining each of the through holes 72*b* are tapered surfaces tapered toward the piezoelectric layer 71 (lower side). Therefore, by making the liquid droplet of the electroconductive material flow along the inner surfaces of the substrate 72 defining the through holes 72*a* and 72*b*, the electroconductive materials 74 and 75 can be filled assuredly in the through holes 72*a* and 72*b*, respectively.

Next, modified embodiments in which various modifications are made in the second embodiment will be explained below.

Third Modified Embodiment

The through hole 70*a* may not be formed in the vibration plate 70. In this case, the through hole 71*a* and through hole 72*c* are communicated mutually, and the electroconductive material 75 filled in the through hole 72*c* and the through hole 71*a* is joined (connected) to the wiring 76 and the upper surface of the vibration plate 70. Therefore, the vibration plate 70 and the wiring 76 are electrically connected by the electroconductive material 75. In this case, a step of forming the through hole 71*a* in the piezoelectric layer 71 by a method such as laser machining is required separately.

Fourth Modified Embodiment

In the second embodiment, one through hole 70*a* and one through holes 71*a* communicating with one of the through holes 72*b* are formed in the vibration plate 70 and the piezoelectric layer 72 respectively. However, a plurality of trough holes 70*a* and a plurality of through holes 71*a* may be formed in the vibration plate 70 and the piezoelectric layer 71 respectively, such that the through holes 70*a* and through holes 71*a* communicate with through holes 72*b* among the plurality of through holes 72*b*.

In the first embodiment and the second embodiment, examples in which the present invention is applied to the ink-jet head are explained. However, other than the above, the present invention is also applicable to a liquid transporting apparatus which transports a liquid other than ink such as a reagent, a biomedical solution, a wiring-material solution, an electronic-material solution, a cooling medium (refrigerant), a fuel, and the like.

Third Embodiment

Figure 16:
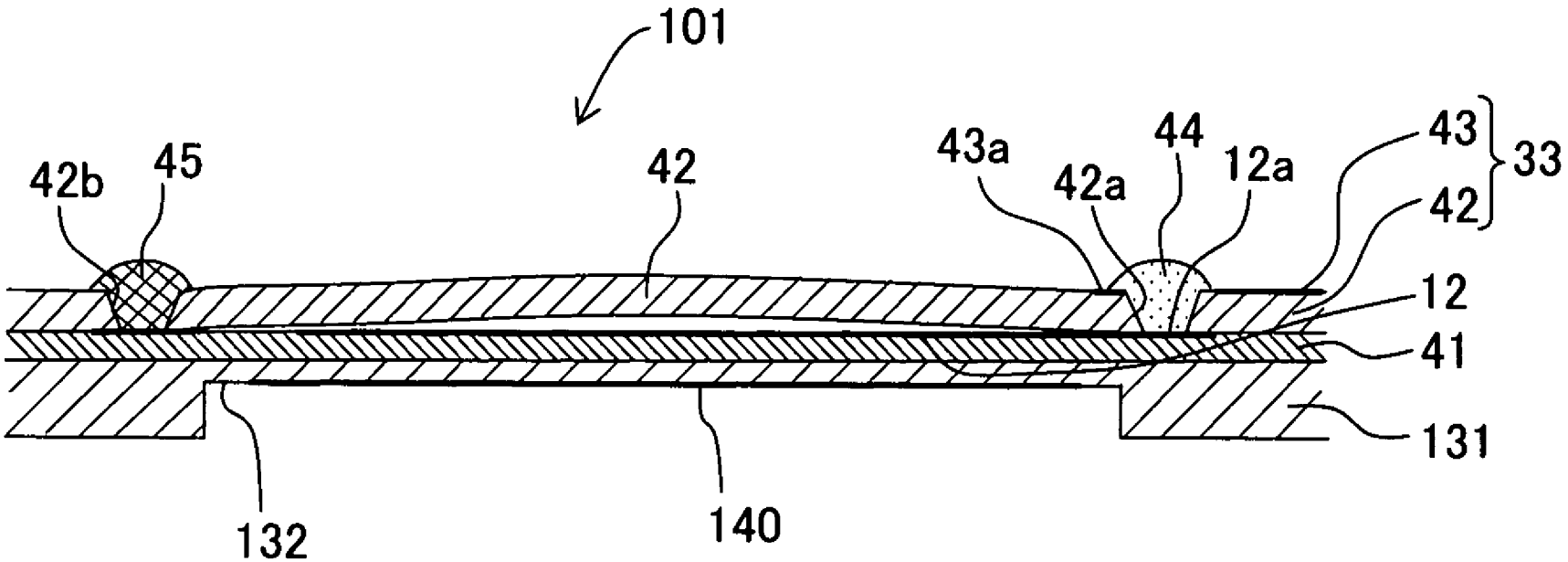
FIG. 16 is a schematic diagram of an actuator unit according to a third embodiment.

An actuator unit 101 of a third embodiment has a structure similar to the structure of the ink-jet head 3 of the first embodiment except that the actuator unit 101 has a plate 131 made of a metallic material, instead of the channel unit 31. Here, as shown in FIG. 16, recesses 132 which open on a side (lower side) opposite to the piezoelectric layer 41 are formed in areas of the plate 131 each of which overlap with the main area (first area) of one of the individual electrodes 12 of the actuator unit 101. A stiffness of the area of the plate 131 in which the recess 132 is formed is lower than a stiffness of an area (supporting portion) of the plate 131 in which the recess 132 is not formed. Therefore, when an electric potential is applied between and a desired individual electrode 12 among the individual electrodes 12 and the plate 131 which serves also as the common electrode so as to deform a portion of the piezoelectric layer 41 sandwiched between these electrodes, there is no fear that the deformation of the piezoelectric layer 41 is hindered. Such an actuator unit 101 can be used for various applications. For example, as shown in FIG. 16, by providing a mirror 104 in each of the recesses 132, the actuator unit 101 can be used as a multimirror capable of deforming desired mirror or mirrors 104. The mirrors 140 can be formed, for example, by applying silver by a vapor deposition on a surface of the plate 131 in which the recesses 132 are formed. By deforming the desired mirror 140, it is possible to adjust intensity and direction of light reflected by the multimirror, or it is also possible to make a letter, character or the like to appear on a surface of the multimirror.

In the actuator unit of the third embodiment, it is not necessarily indispensable that the recess is formed in the plate, provided that the stiffness of the area of the plate, which overlaps with the individual electrode of the piezoelectric actuator is low to an extent such that the deformation of the piezoelectric layer is not hindered. Further, the substrate may be made of any material and may have any shape. When the substrate is formed of a material having an insulating property, it is possible to form the common electrode between the substrate and the piezoelectric layer. Further, the actuator unit of the third embodiment may be used for any application other than the application as the multimirror.

What is claimed is:

1. A liquid transporting apparatus which transports a liquid, comprising:

a channel unit in which a pressure chamber, a liquid discharging port, and a liquid channel reaching up to the liquid discharging port via the pressure chamber are formed;

a piezoelectric actuator which applies a discharge energy to the liquid in the pressure chamber and which includes: a plate fixed to one surface of the channel unit to cover the pressure chamber, a piezoelectric layer stacked on the plate to face the pressure chamber, and an electrode having a first area facing the pressure chamber and a second area not facing the pressure chamber, the electrode being formed on a surface of the piezoelectric layer on a side opposite to the plate so as to extend from the first area to the second area;

a wiring section which is connected to the piezoelectric actuator to supply a drive voltage to the piezoelectric actuator, and which includes: a substrate which is insulative and which is arranged to cover the piezoelectric actuator; a first wiring formed on a surface of the substrate on a side opposite to the piezoelectric actuator; a first through hole formed in an area of the substrate which overlaps with the second area of the electrode; and a second through hole formed in another area of the substrate which does not overlap with the pressure chamber and is different from the second area;

an electroconductive material filled in the first through hole and joined to the first wiring and the second area of the electrode to electrically connect the first wiring and the electrode; and a fixing material which is filled in the second through hole and joined to the substrate and the piezoelectric actuator to fix the wiring section to the piezoelectric actuator.

2. The liquid transporting apparatus according to claim 1, wherein:

the liquid channel is formed as a plurality of individual liquid channels, and the pressure chamber is formed as a plurality of pressure chambers;

in the piezoelectric actuator, the plate and the piezoelectric layer are formed to cover the pressure chambers, and the electrode is formed as a plurality of individual electrodes corresponding to the pressure chambers respectively; and in the wiring section, the first through hole and the second through hole are formed as a plurality of first through holes and as a plurality of second through holes respectively.

3. The liquid transporting apparatus according to claim 2, wherein the second through holes are formed at positions each of which is outside of a first hole included in the first holes and formed on the outermost side in a predetermined direction in the substrate.

4. The liquid transporting apparatus according to claim 1, wherein inner surfaces of the substrate which define the first through hole and the second through hole respectively, are tapered toward the piezoelectric layer.

5. The liquid transporting apparatus according to claim 1, wherein the fixing material is formed of an electroconductive material.

6. The liquid transporting apparatus according to claim 5, wherein:

the piezoelectric layer of the piezoelectric actuator has a dummy electrode, which is insulated from the individual electrode, in an area on a surface of the piezoelectric layer opposite to the plate and facing the another area of the substrate in which the second through hole is formed; and the fixing material filled in the second through hole is joined to the substrate and the dummy electrode.

7. The liquid transporting apparatus according to claim 5, wherein:

the wiring section further includes a second wiring which is formed on the surface of the substrate on the side opposite to the piezoelectric actuator;

the plate is made of an electroconductive material;

a third through hole penetrating through the piezoelectric layer is formed in an area, of the piezoelectric actuator, overlapping with the second through hole; and the fixing material is filled in the second through hole and the third through hole and joined to the second wiring and the plate to electrically connect the second wiring and the plate.

8. The liquid transporting apparatus according to claim 7, wherein:

an opening of the pressure chamber is formed on the one surface of the channel unit; and the third through hole penetrates through the piezoelectric layer and the plate and is formed to correspond to a position in the one surface of the channel unit at which the opening of the pressure chamber is absent.

9. The liquid transporting apparatus according to claim 1, wherein a projection projecting toward a side opposite to the plate is formed in an area on the surface of the piezoelectric layer on the side opposite to the plate, the area not overlapping with the pressure chamber.

10. The liquid transporting apparatus according to claim 1, wherein a projection projecting toward the piezoelectric layer is formed in an area on a surface of the substrate of the wiring section, the surface facing the piezoelectric layer, and the area not overlapping with the pressure chamber.

11. The liquid transporting apparatus according to claim 1, wherein the wiring section is arranged in an area overlapping with the pressure chamber to form a gap between the wiring section and the piezoelectric actuator.

12. An actuator unit comprising:

a piezoelectric actuator which includes: a plate which is supported by a supporting section; a piezoelectric layer which is stacked on one surface of the plate; and an electrode formed on a surface of the piezoelectric layer on a side opposite to the plate, and having a first area and a second area, the first area not overlapping with a supported area which is supported by the supporting section of the plate, and the second area overlapping with the supported area of the plate;

a wiring section which is connected to the piezoelectric actuator to supply a drive voltage to the piezoelectric actuator, and which includes: a substrate which is insulative and which is arranged to cover the piezoelectric actuator; a first wiring formed on a surface of the substrate on a side opposite to the piezoelectric actuator; a first through hole formed in an area, of the substrate, overlapping with the second area of the electrode; and a second through hole formed in another area of the substrate which overlaps with the supported area of the plate and is different from the second area of the electrode;

an electroconductive material which is filled in the first through hole to electrically connect the first wiring and the electrode; and a fixing material which is filled in the second through hole to fix the wiring section to the piezoelectric actuator.

13. A method of producing a liquid transporting apparatus, the liquid transporting apparatus including:

a channel unit in which a pressure chamber is formed;

a piezoelectric actuator which applies a discharge energy to the liquid in the pressure chamber, and which has: a plate fixed to one surface of the channel unit to cover the pressure chamber; a piezoelectric layer stacked on the plate to face the pressure chamber; and an electrode formed on a surface of the piezoelectric layer on a side opposite to the plate; and a wiring section including a substrate which is insulative and in which a first wiring is formed, the wiring section being connected to the piezoelectric actuator to supply a drive voltage to the piezoelectric actuator, the method comprising:

a step of providing the substrate and the piezoelectric actuator which is connected to the channel unit;

a wiring-section forming step of forming the wiring section by forming a first through hole in an area, of the substrate, which overlaps with the electrode and does not overlap with the pressure chamber when the substrate is connected to the piezoelectric actuator which has been connected to the channel unit; and by forming a second through hole in another area of the substrate which does not overlap with the electrode and the pressure chamber when the substrate is connected to the piezoelectric actuator which has been connected to the channel unit;

an arranging step of arranging the substrate of the wiring section such that the area of the substrate in which the first through hole is formed overlaps with a connecting area of the electrode;

an electroconductive liquid droplet jetting step of jetting a liquid droplet of an electroconductive material, toward the first through hole in the substrate, from a side of the substrate opposite to the piezoelectric layer of the piezoelectric actuator;

an electroconductive liquid droplet curing step of curing the liquid droplet of the electroconductive material jetted in the electroconductive liquid droplet jetting step;

a fixing liquid droplet jetting step of jetting a liquid droplet of a fixing material toward the second through hole from the side of the substrate opposite to the piezoelectric layer; and a fixing liquid droplet curing step of curing the liquid droplet of the fixing material jetted in the fixing liquid droplet jetting step.

14. The method of producing the liquid transporting apparatus according to claim 13, wherein the fixing liquid droplet jetting step is performed before the electroconductive-liquid droplet jetting step.

15. The method of producing the liquid transporting apparatus according to claim 13, wherein the liquid droplet of the fixing material is the liquid droplet of the electroconductive material; and the electroconductive liquid droplet jetting step and the fixing liquid droplet jetting step are performed simultaneously.

16. The method of producing the liquid transporting apparatus according to claim 15, wherein after simultaneously performing the electroconductive liquid droplet jetting step and the fixing liquid droplet jetting step, the electroconductive liquid droplet curing step and the fixing liquid droplet curing step are performed simultaneously.

17. The method of producing the liquid transporting apparatus according to claim 13, further comprising, before the arranging step, a projection forming step of forming a projection, which projects toward a side opposite to the plate, at an area on the surface of the piezoelectric layer on the side opposite to the plate, the area not overlapping with the pressure chamber.

18. A method of producing a liquid transporting apparatus, the liquid transporting apparatus including:

a channel unit in which a pressure chamber is formed;

a piezoelectric actuator having a plate formed of an electroconductive material and fixed to one surface of the channel unit to cover the pressure chamber, a piezoelectric layer stacked on the plate to face the pressure chamber, and an electrode formed on a surface of the piezoelectric layer on a side opposite to the plate; and a wiring section arranged to cover the piezoelectric actuator, connected to the piezoelectric actuator to supply a drive voltage to the piezoelectric actuator, and including a substrate which is insulative and which has a first wiring for applying the drive voltage to the electrode and a second wiring for applying a fixed electric potential to the plate, the first wiring and the second wiring being formed in the substrate;

the method comprising:

a step of providing the substrate, the plate, and the channel unit;

a wiring section forming step of forming the wiring section by forming a first through hole in an area, of the substrate, which overlaps with the electrode and does not overlap with the pressure chamber when the substrate is connected to the piezoelectric actuator, and forming a second through hole in another area of the substrate which does not overlap with the pressure chamber and the electrode when the substrate is connected to the piezoelectric actuator;

a through hole forming step of forming a through hole in an area of the plate which does not overlap with the pressure chamber when the plate is connected to the channel unit;

a step of forming the piezoelectric layer on one surface of the plate, with one of an aerosol deposition method and a vapor deposition method and after the through hole forming step, to form a third through hole in the area of the plate in which the through hole has been formed, the third through hole penetrating through the plate and the piezoelectric layer;

a first electrode forming step of forming a first electrode on a surface of the piezoelectric layer on a side opposite to the plate;

an arranging step of arranging the substrate of the wiring section such that the area of the substrate in which the first through hole has been formed overlaps with a connecting area of the first electrode, and that the another area of the substrate in which the second through hole has been formed overlaps with the area of the plate and an area of the piezoelectric layer in which the third through hole has been formed;

an electroconductive liquid droplet jetting step of jetting a liquid droplet of an electroconductive material, toward the first through hole and the second through hole formed in the substrate, from a side of the substrate opposite to the piezoelectric layer; and an electroconductive droplet curing step of curing the liquid droplet of the electroconductive material jetted in the electroconductive liquid droplet jetting step.

* * * * *